US009788663B2

(12) United States Patent
Furuland

(10) Patent No.: US 9,788,663 B2
(45) Date of Patent: Oct. 17, 2017

(54) MULTIFUNCTION INFANT BED

(71) Applicant: Enfant Terrible Design AB, Norrtalje (SE)

(72) Inventor: Lisa Furuland, Norrtalje (SE)

(73) Assignee: Enfant Terrible Design AB, Norrtalje (SE)

( * ) Notice: Subject to any disclaimer, the term of this patent is extended or adjusted under 35 U.S.C. 154(b) by 0 days.

(21) Appl. No.: 15/278,886

(22) Filed: Sep. 28, 2016

(65) Prior Publication Data

US 2017/0013970 A1 Jan. 19, 2017

Related U.S. Application Data

(63) Continuation of application No. 13/673,253, filed on Nov. 9, 2012, now abandoned.

(60) Provisional application No. 61/557,757, filed on Nov. 9, 2011.

(51) Int. Cl.

| | |
|---|---|
| ***A47D 9/00*** | (2006.01) |
| ***A47D 7/01*** | (2006.01) |
| ***A47D 15/00*** | (2006.01) |

(52) U.S. Cl.

CPC ..... *A47D 9/00* (2013.01); *A47D 7/01* (2013.01); *A47D 9/005* (2013.01); *A47D 15/003* (2013.01); *A47D 15/008* (2013.01)

(58) Field of Classification Search

CPC ..... A47D 13/08; A47D 7/01; A47D 15/003; A47D 9/005; A47D 15/008; A47D 9/00; A47C 16/00; A47C 27/003; A47G 9/10; A61G 7/0507

USPC ..... 5/655, 657, 657.5, 652, 425

See application file for complete search history.

(56) References Cited

U.S. PATENT DOCUMENTS

| | | | |
|---|---|---|---|
| 2,626,407 | A | 1/1953 | Kurry |
| 3,583,765 | A | 6/1971 | Wallis |
| 3,761,975 | A | 10/1973 | Personett |
| 4,383,713 | A | 5/1983 | Roston |
| 4,607,402 | A | 8/1986 | Pollard |
| 4,788,726 | A | 12/1988 | Rafalko |
| 4,802,244 | A | 2/1989 | McGrath-Saleh |
| 5,035,013 | A | 7/1991 | Bloom |
| 5,088,139 | A | 2/1992 | Bloom |
| 5,137,333 | A | 8/1992 | Chee |
| D330,139 | S | 10/1992 | Bloom |
| 5,165,130 | A | 11/1992 | Wendling |

(Continued)

FOREIGN PATENT DOCUMENTS

| | | |
|---|---|---|
| DE | 20007258 U1 | 10/2000 |
| DE | 20203973 U1 | 7/2002 |

(Continued)

OTHER PUBLICATIONS

Executed Declaration of Lisa Furuland dated Dec. 27, 2016.

PCT International Search Report and Written Opinion issued in PCT/IB2012/002888 on Aug. 2, 2013.

*Primary Examiner* — Eric Kurilla

(74) *Attorney, Agent, or Firm* — Stroock & Stroock & Lavan LLP

(57) ABSTRACT

A bed configured to contain a subject, such as a human infant is disclosed. The bed includes a womb-shaped bumper capable of constricting or squeezing the subject. The bumper is adjustable between a constricting configuration and a non-constricting configuration. An adjustment mechanism, and optionally, a fastener may be used to maintain the bumper in the constricting configuration.

13 Claims, 22 Drawing Sheets

(56) References Cited

U.S. PATENT DOCUMENTS

| | | | |
|---|---|---|---|
| 5,242,338 | A | 9/1993 | Hatdegen, III, et al. |
| 5,392,785 | A | 2/1995 | Donahue |
| 5,448,790 | A | 9/1995 | Saro et al. |
| 5,519,906 | A | 5/1996 | Fanto-Chan |
| 5,551,109 | A | 9/1996 | Tingley et al. |
| 5,586,351 | A | 12/1996 | Ive |
| D393,772 | S | 4/1998 | Vingino |
| 5,813,066 | A | 9/1998 | Gebhard et al. |
| 6,047,420 | A | 4/2000 | Priester, III et al. |
| 6,505,366 | B1 | 1/2003 | Lied |
| 6,536,058 | B1 | 3/2003 | Chang |
| 6,588,036 | B1 | 7/2003 | Hort |
| 7,404,219 | B2 | 7/2008 | Berkey |
| 7,588,291 | B2 | 9/2009 | Gold et al. |
| 7,676,871 | B1 | 3/2010 | Leach |
| 7,926,135 | B1 | 4/2011 | Leach |
| 8,024,829 | B2 | 9/2011 | Carr et al. |
| 8,419,128 | B1 | 4/2013 | Leach |
| 8,458,830 | B1 | 6/2013 | Pierce et al. |
| 8,555,429 | B2 | 10/2013 | Leach |
| 2005/0076444 | A2 | 4/2005 | Houghteling |
| 2005/0155155 | A1 | 7/2005 | Kassai et al. |
| 2005/0172408 | A1 | 8/2005 | Temple |
| 2005/0210591 | A1 | 9/2005 | Mead et al. |
| 2007/0245494 | A1 | 10/2007 | Dockendorf |
| 2007/0256242 | A1 | 11/2007 | Warnock |
| 2008/0040854 | A1 | 2/2008 | Lorentz |
| 2008/0182477 | A1 | 7/2008 | Catelli |
| 2009/0083908 | A1 | 4/2009 | Fry |
| 2009/0151080 | A1 | 6/2009 | Lord |
| 2009/0193589 | A1 | 8/2009 | Carr et al. |
| 2009/0222993 | A1 | 9/2009 | Villanueva et al. |
| 2011/0119833 | A1 | 5/2011 | Clark |
| 2011/0191956 | A1 | 8/2011 | Rabess et al. |
| 2011/0277210 | A1 | 11/2011 | Hardesty |

FOREIGN PATENT DOCUMENTS

| | | |
|---|---|---|
| FR | 2911776 A1 | 8/2008 |
| SE | 80690 | 8/2009 |

MULTIFUNCTION INFANT BED

CROSS-REFERENCE TO RELATED APPLICATION

The present application is a continuation application of U.S. application Ser. No. 13/673,253, filed Nov. 9, 2012, which claims priority to U.S. Provisional Patent Application No. 61/557,757, filed on Nov. 9, 2011, which is hereby incorporated by reference in its entirety.

BACKGROUND OF THE INVENTION

1. Field of the Invention

The present invention generally relates to a multifunctional infant bed.

2. Description of the Related Art

An infant's proximity to a parent is crucial for the infant's mental, emotional, and psychological development. Being nestled in the arms, against the chest, and near the parent's face gives the infant a soothing environment. But when parents are not available, the second best option is to create an environment which resembles the womb. The current devices that hold infants have various drawbacks. For example, a parent may lay an infant on a blanket; however, the blanket space may be too open, hard, and uncomfortable for the infant. A cot may prevent an infant from visual exploration. Additionally, cots or cribs may not be snug enough for a newborn. An infant lounger would require buckling the infant in, thereby restricting his or her movement.

Furthermore, it is important for infants to get what is called "tummy time," during which infants are positioned on their stomach. The benefits of "tummy time" are many. For example, "tummy time" allows an infant to develop their motor control and planning, sensory integration, environmental awareness, and postural strength. "Tummy time" also gives infants the important ability to strengthen their neck muscles to prepare them for crawling. It also helps infants get ready to push up, roll over, sit up, and eventually stand. Furthermore, the "tummy time" position takes the pressure off of the infant's occipital area or the back of their heads. But many infants do not enjoy tummy time, and appear miserable in this position. For example, when placed on their stomach without any neck support, many infants cry or even refuse to lift their head.

Another important infant activity is co-sleeping of the infant and their parents. Co-sleeping promotes an increase in the infant's self-esteem, confidence, sensitively as well as environmental acceptance. For example, the infant may benefit from the calming effect on their breathing and heart function while lying next to their parents, which may reduce the risk of cot death, also known as sudden infant death syndrome. A co-sleeping infant also needs prevention from rolling out of bed, hitting their head against a headboard, getting caught between the bed and the wall, or wriggling under the covers. A co-sleeping infant may also need prevention from the risk of suffocation that exists with soft adult mattresses.

Furthermore, an infant may preferentially lie on only one side of their head, which may result in positional or deformational plagiocephaly, also known as flattened head syndrome.

Thus, there is a need for an apparatus that provides a comfortable and snug environment resembling the womb, while at the same allowing an infant to visually explore their surroundings without restriction in their movement. Additionally, there is a need for an apparatus that allows an infant to be propped on their tummy while still providing some support for their neck muscles. There is also a need for an apparatus that allows an infant to co-sleep with their parents while preventing an infant from rolling out of bed, hitting their head against a headboard, getting caught between the bed and the wall, or wriggling under the covers, and that reduces the risk of suffocation that exists with soft adult mattresses. Additionally, there is a need for an apparatus that encourages an infant to alter the resting position of their head, thereby reducing the risk of flattened head syndrome.

SUMMARY OF THE INVENTION

In view of the above discussion and the shortcomings in the prior art, various embodiments of the invention seek to overcome such shortcomings of the prior art by providing a multifunctional bed for infants.

According to various embodiments of the present invention, a novel multifunctional bed is disclosed. The multifunctional bed includes, e.g., a bumper and a bottom that may be permanently attached, or attachable and/or separable from one another. The bumper may have a shell that is filled with a filler material, for example, fiber, or foam. The bumper may be configured in an womb-like shape, such as an oval shape (including, e.g., rounded and elliptical shapes) and preferably runs along the perimeter of the multifunctional bed. The bumper may be raised from the bottom to form a recess where a subject, e.g., a human infant may be placed. The bumper further includes a fastener, e.g., a clasp, for connecting two ends of the bumper to form the bumper's oval shape. The bumper may also include one or more handles that allow a user to carry the multifunctional bed. The bottom may be rectangular in shape. Additionally, the bottom may be filled with filler material, such as fiber or foam. Alternatively, the bumper and bottom may be formed as a unitary structure. When the bumper is formed as a separate structure from the bottom, the bumper and the bottom may be fastened to each other via a variety of fasteners.

According various embodiments of the invention, a novel multifunctional bed is disclosed. The multifunctional bed preferably includes a bumper and a bottom that may be unitary in structure. The bumper may be filled with a filler material, such as fiber or foam, and an insert. The bed may be in an oval shape when filled with the insert. The bumper preferably runs along the perimeter of the multifunctional bed and may be raised from the bottom forming a recess where an infant may be placed. The bumper includes one or more zippers that allow a user to remove or replace the insert from the bumper. These zippers are preferably infant safe zippers that do not have a pull tab. The bumper further includes a clasp that connects two ends of the bumper to form the bumper's oval shape. The bumper further includes one or more handles that allow a user to carry the multifunctional bed. The bottom is preferably in a rectangular shape and is also filled with an insert. The bottom includes a zipper that allows a user to remove or replace the insert from the bottom.

According to other embodiments of the present invention, the multifunctional bed may further include mesh windows on opposing sides of the bumper. The mesh windows allowing an infant pressed against them to breathe air by allowing airflow between the inside and outside of the multifunctional bed. A bumper indentation in the mesh area may be hollow, such that no fibers or foam or minimal fibers or foam may be provided in the mesh area of the bumper.

According to another embodiment of the present invention, the multifunctional bed may be positioned on a base. The base can be in an incline wedge shape and may be separate from and attachable to the multifunctional bed. The base would have a shell and filler material. The base may be attachable to the multifunctional bed via a plurality of fasteners.

It should be noted that although the description herein describes the multifunctional bed as being used by an infant, it can be appreciated by one of ordinary skill in the art that certain aspects of the present invention can be used for children of any other age or size, as well as for other living beings, such as animals.

BRIEF DESCRIPTION OF THE DRAWINGS

Certain embodiments of the present invention will be better understood when read in conjunction with the appended drawings wherein like reference numerals refer to like components. For the purposes of illustrating the present application, there is shown in the drawings various embodiments. It should be understood and appreciated, however, that the application is not limited to the precise arrangements, structures, features, embodiments, aspects, and devices shown, and the arrangements, structures, features, embodiments, aspects and devices shown and may be used singularly or in combination with other arrangements, structures, features, embodiments, aspects and devices.

The drawings are not necessarily drawn to scale and are not in any way intended to limit the scope of this invention, but merely to clarify the various embodiments of the invention. In the drawings.

DETAILED DESCRIPTION OF THE PREFERRED EMBODIMENTS

Figure 1:
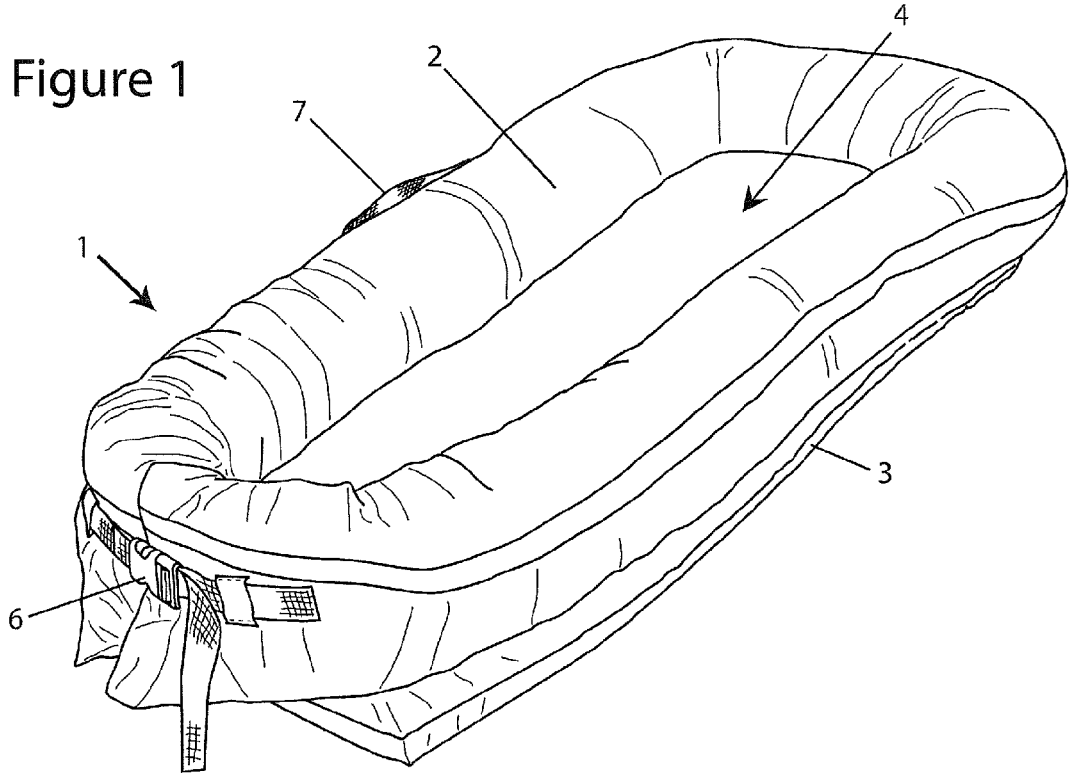
FIG. 1 is a perspective view of a multifunctional bed according to an embodiment of the present invention.
Figure 2:
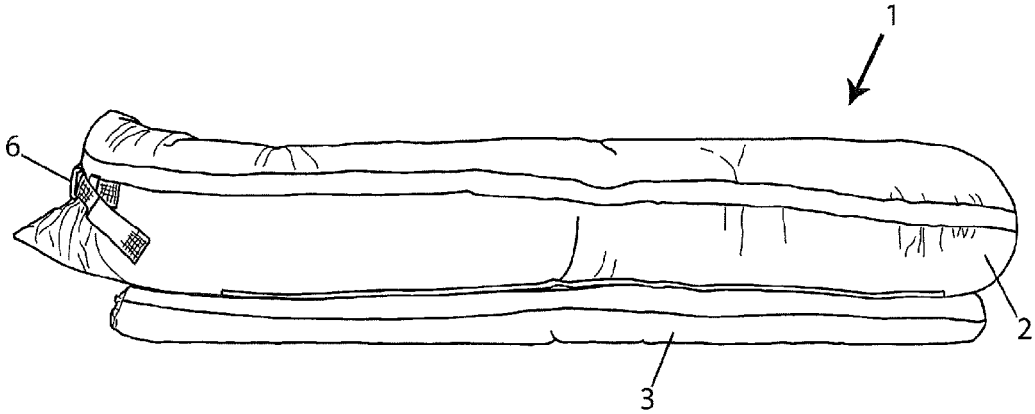
FIG. 2 is a side view of the multifunctional bed of FIG. 1.
Figure 3:
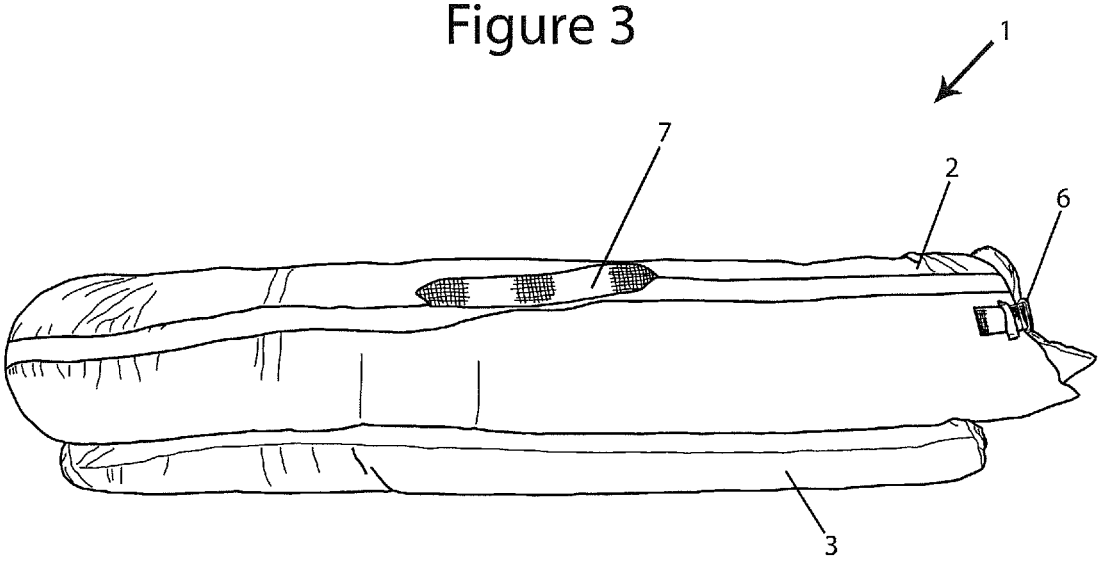
FIG. 3 is a side view of the opposite side of the multifunctional bed of FIG. 1.
Figure 4:
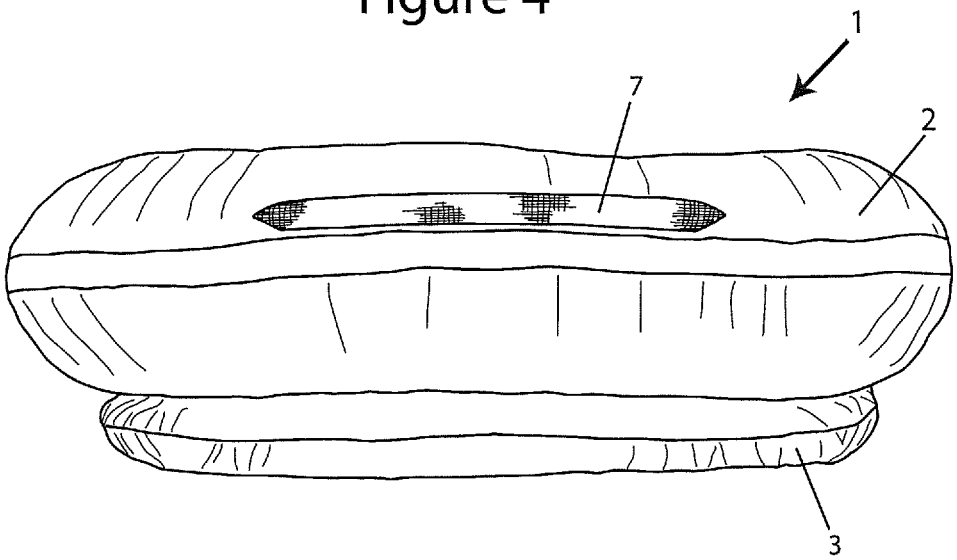
FIG. 4 is a back view of the multifunctional bed of FIG. 1.

Certain exemplary embodiments of the invention will now be discussed with reference to the aforementioned figures. In general, such embodiments relate to a multifunctional bed for an infant, although as one of ordinary skill in the art can appreciate, certain embodiments of the present invention can be utilized in connection with various other living beings, such as children, adults, animals or the like. Embodiments of a multifunctional bed according to the present invention are described below. These embodiments are provided for the purpose only of illustrating principles of the present invention, and should not be interpreted as limiting the invention in any way beyond the scope of the claims and their equivalents.

An embodiment of a multifunctional bed 1 is illustrated in FIGS. 1-7. The multifunctional bed 1 may be used as a standalone product, or may be used as a crib or cot insert. The multifunctional bed 1 may be used by a parent when co-sleeping with an infant. The multifunctional bed 1 preferably has anti-dust-mite, anti-fungal and anti-bacterial properties.

As can be seen in FIGS. 1-7, the multifunctional bed 1 includes a bumper 2 and a bottom 3. The bumper 2 is preferably in a horseshoe shape, where the ends of the horseshoe of the bumper 2 can be connected with a clasp 6 to form an oval shape. The bumper 2 is preferably composed of a shell made of a breathable, machine washable material such as cotton, that may have anti-dust-mite, anti-fungal and anti-bacterial properties and may be composed of a coated non-woven material. The shell of bumper 2 is preferably filled with filler material, such as fiber or foam. The filler material may include cluster fibers, foam, thermobonded (poly) fiber, or wadding. The filler material may have antimicrobial properties. When the clasp 6 is fastened, the bumper 2 is preferably in an oval shape that runs along the perimeter of the multifunctional bed 1. Additionally, the profile of the bumper 2 is preferably raised from the bottom 3, forming a recess 4. The height of the profile of the bumper 2 is preferably high enough to confine an infant within the space of the bumper 2, but low enough to allow an infant to visually observe surroundings. In preferred embodiments, an infant may be placed in the recess 4 of the multifunctional bed 1. The infant may be placed on their back or on their stomach in the recess 4. Alternatively, an infant may be placed partially in the recess 4 and partially on the bumper 2.

Figure 5:
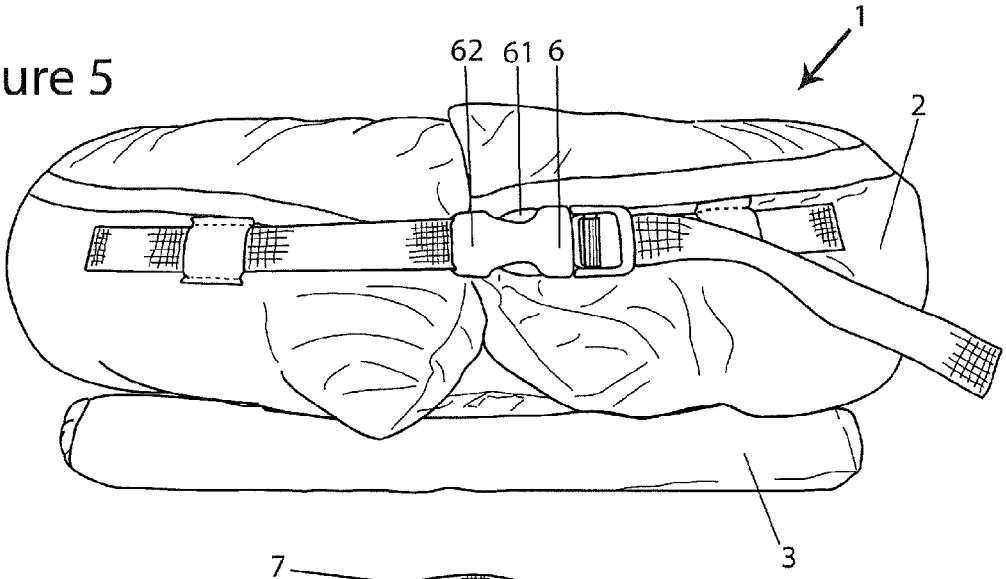
FIG. 5 is a front view of the multifunctional bed of FIG. 1.
Figure 6:
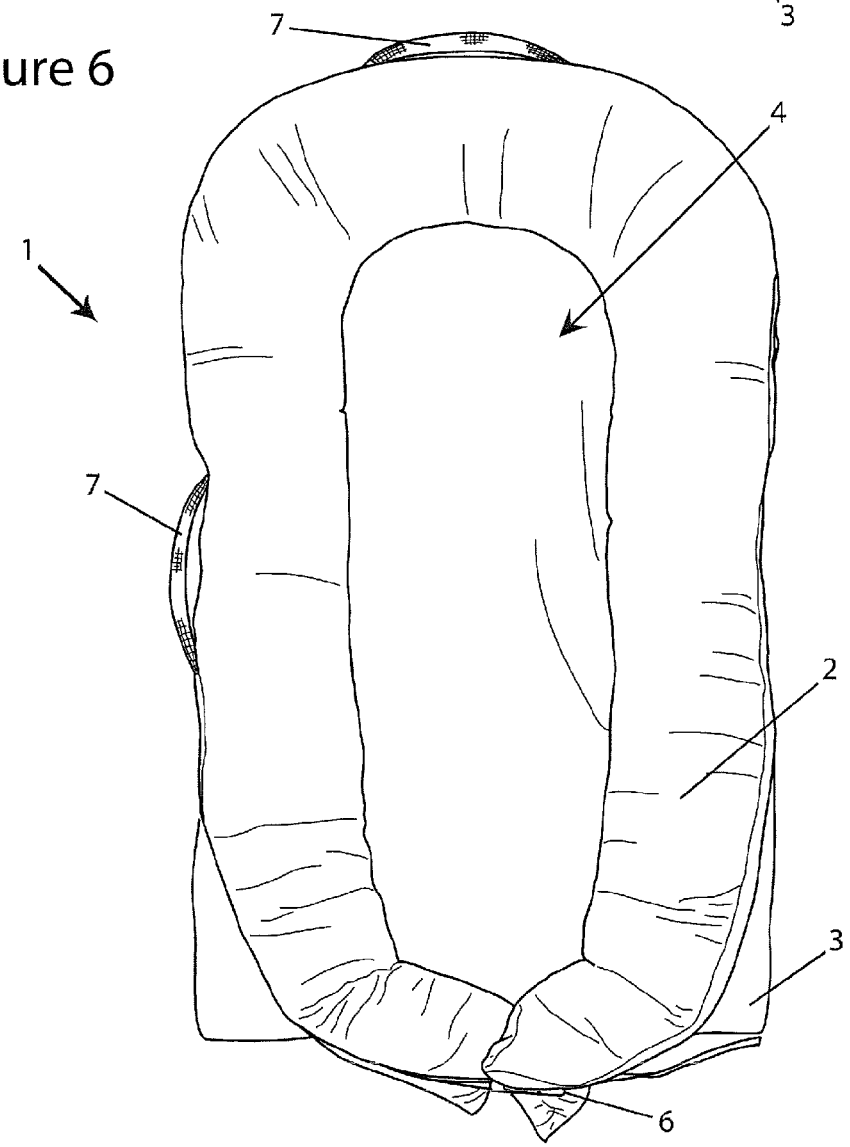
FIG. 6 is a top view of the multifunctional bed of FIG. 1.

With reference to FIGS. 1-7, and in particular FIG. 5, the clasp 6 of the bumper 2 preferably includes two parts—a male part 61 and a female part 62. The clasp 6 preferably connects the ends of bumper 2, forming a recess 4 where an infant may be placed. The male part 61 is preferably connected to one end of bumper 2 while the female part 62 is preferably connected to another end of bumper 2. When the clasp 6 is unfastened, the bumper 2 may be in a horseshoe shape, allowing a parent to slide out an infant from the opened end of the bumper 2. Additionally, the clasp 6 may be fastened to the bars of a crib or another stable object, securing the multifunctional bed 1 in place. The bumper 2 further preferably includes one or more handles 7. For example, the bumper 2 may include two handles 7 that allow a user to carry the multifunctional bed 1.

Figure 12:
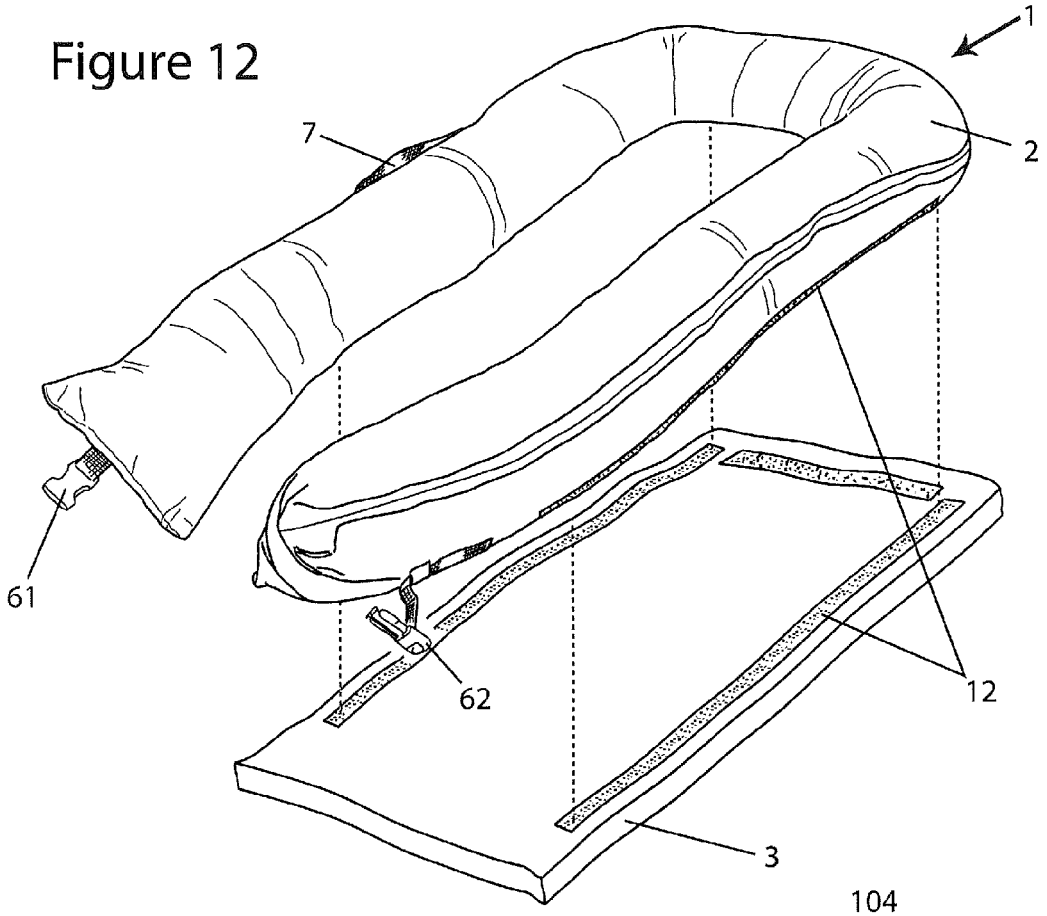
FIG. 12 is an exploded perspective view of a multifunctional bed according to an alternative embodiment of the present invention.

With reference to FIGS. 1-7, the bumper 2 is preferably attached to the bottom 3. In preferred embodiments the bumper 2 and the bottom 3 are composed of the same fabric and are part of a unitary or continuous structure. Alternatively, with reference to FIG. 12, the bumper 2 may be a separate structure from the bottom 3 and may be fastened to the bottom 3 via a fasteners 12. The fasteners 12 may be a variety of fasteners, such as, for example, Velcro™, snaps, buttons, or other fasteners.

Figure 7:
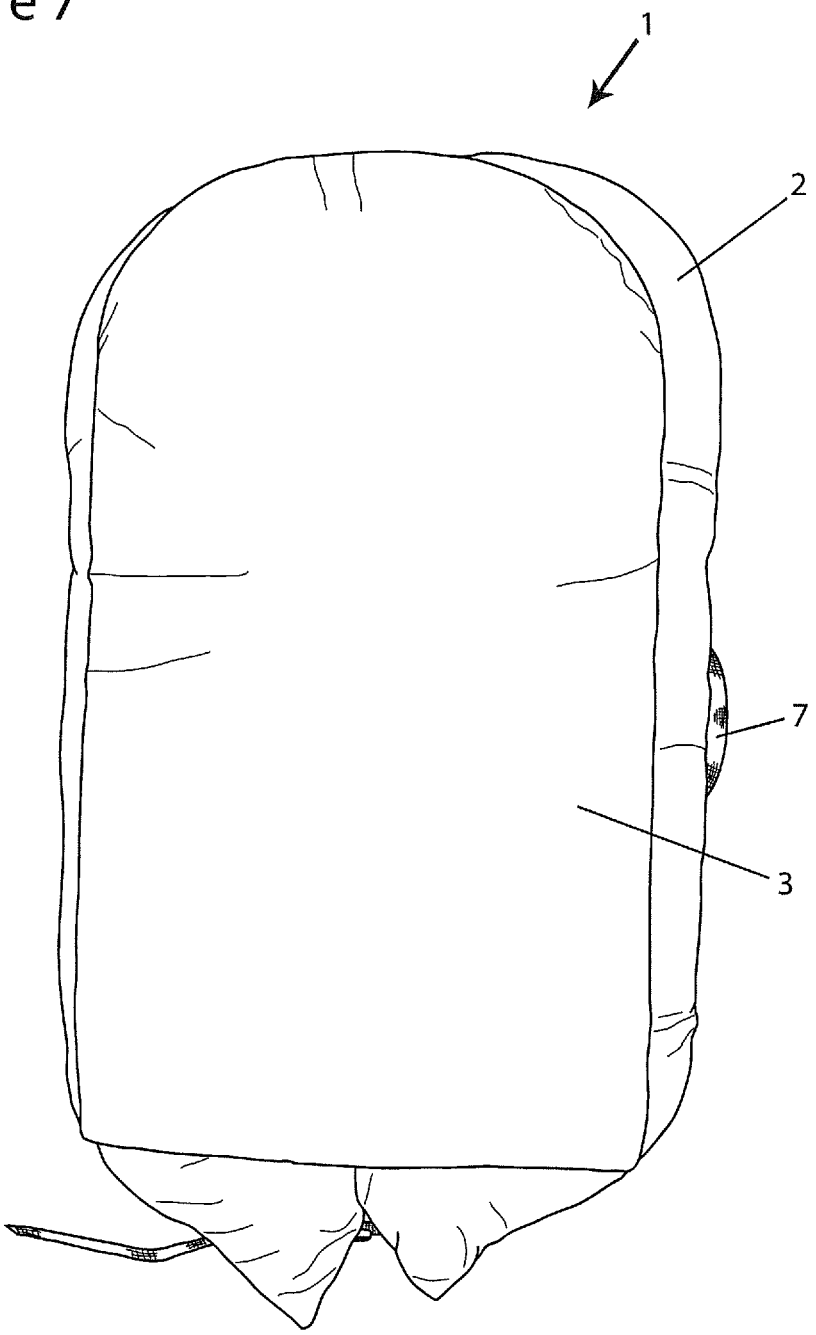
FIG. 7 is a bottom view of the multifunctional bed of FIG. 1.
Figure 8:
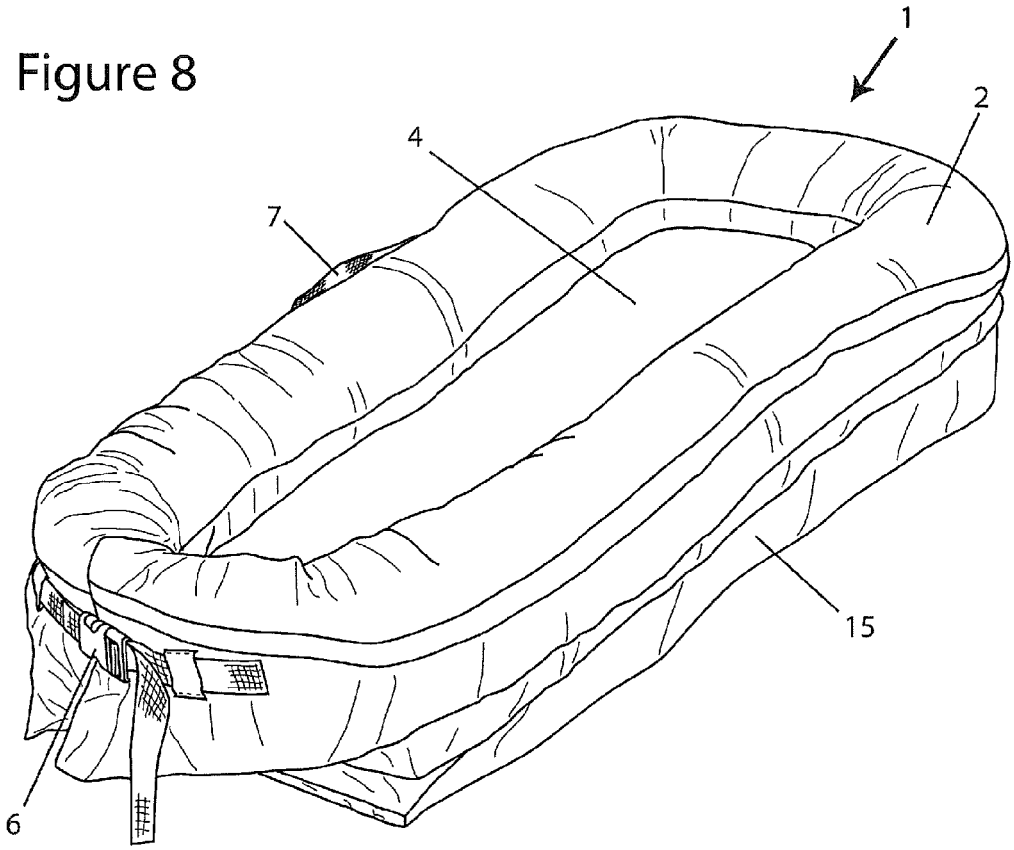
FIG. 8 is a perspective view of the multifunctional bed of FIG. 1 positioned on a base.
Figure 9:
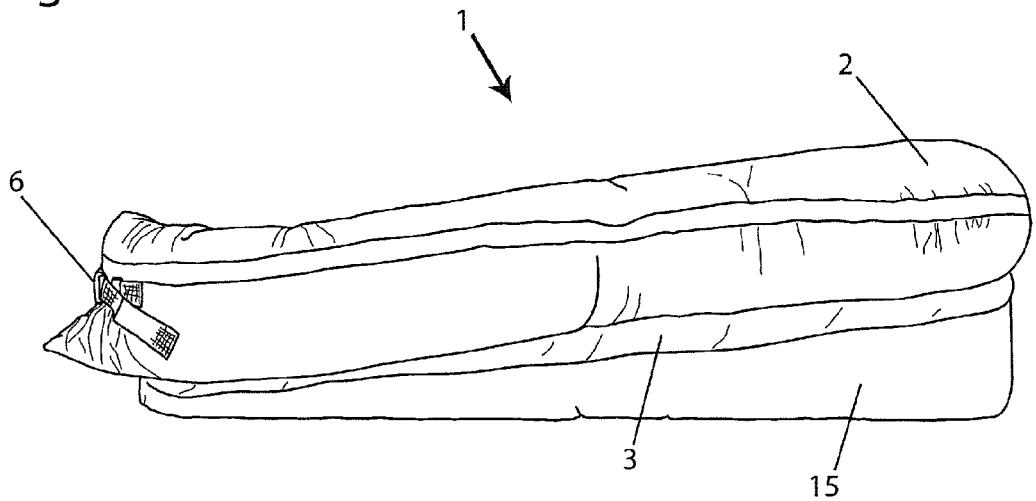
FIG. 9 is a side view of the multifunctional bed and base of FIG. 8.
Figure 10:
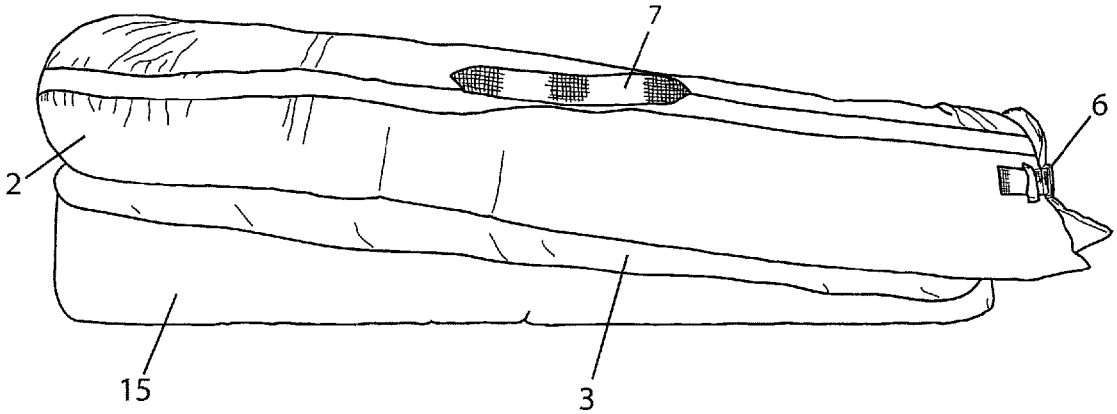
FIG. 10 is a side view of the other side of the multifunctional bed and base of FIG. 8.
Figure 11:
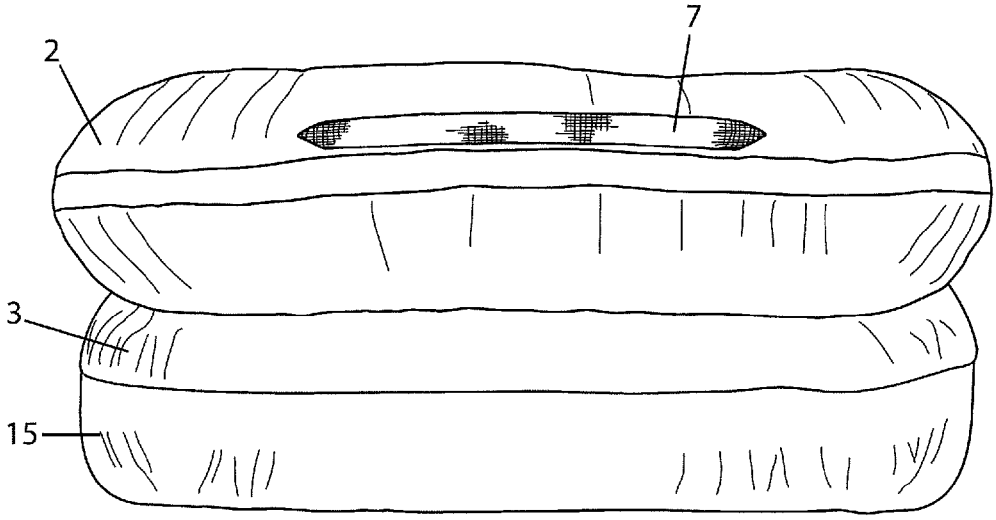
FIG. 11 is a back view of the multifunctional bed and base of FIG. 8.

With reference to FIG. 7, the bottom 3 is preferably in a partially rectangular and partially rounded shape. The part of the bottom 3 that is closest to the clasp 6 has a rectangular shape while the part of the bottom 3 furthest from the clasp 6 has a rounded shape. The bottom 3 has a shell that is preferably filled with filler material, such as fibers or foam. The filler material may include cluster fibers, foam, thermobonded (poly) fiber, or wadding. The filler material may have antimicrobial properties. The bottom 3 preferably provides a soft, yet firm, surface for an infant to lie on.

With reference to FIGS. 8-11, the multifunctional bed 1 can be positioned on a base 15. In preferred embodiments, the base 15 is in an incline wedge shape. The base 15 is separate from and attachable to the multifunctional bed 1. The base 15 has a shell and is preferably filled with filler material. The filler material may include cluster fibers, foam, thermobonded (poly) fiber, or wadding. The base 15 may be attached to the multifunctional bed 1 via one or more fasteners, such as, for example, Velcro™, snaps, buttons, zippers, or other fasteners. The attachment of the base 15 to the multifunctional bed 1 creates an incline position for an infant, where the infant's head is raised relative to the infant's body. This position can relieve an infant's reflux or other abdominal problems. Additionally, when an infant has a cold, this incline position allows the infant to breathe easier.

Another embodiment of a multifunctional bed 100 is illustrated in FIGS. 13-22. The multifunctional bed 100 may be used as a standalone product, or may be used as a crib or cot insert. The multifunctional bed 100 may be used by a parent when co-sleeping with an infant. The multifunctional bed 100 preferably has anti-dust-mite, anti-fungal and anti-bacterial properties.

Figure 13:
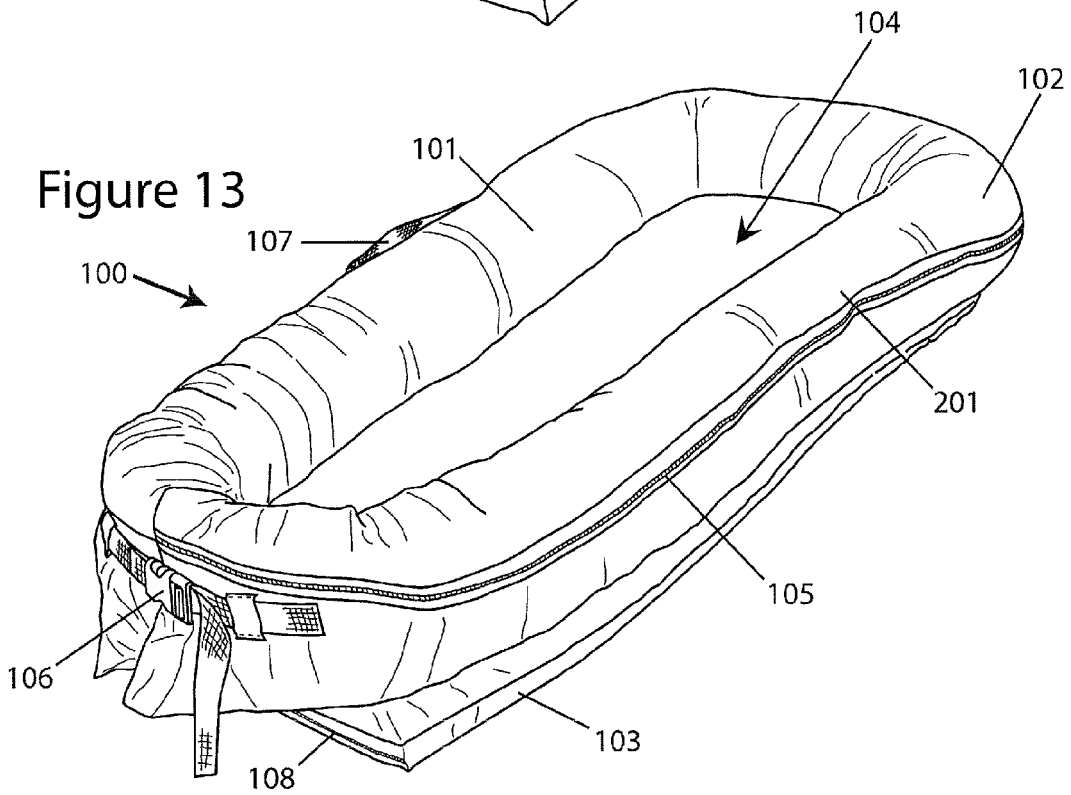
FIG. 13 is a perspective view of a multifunctional bed according to yet another alternative embodiment of the present invention.
Figure 14:
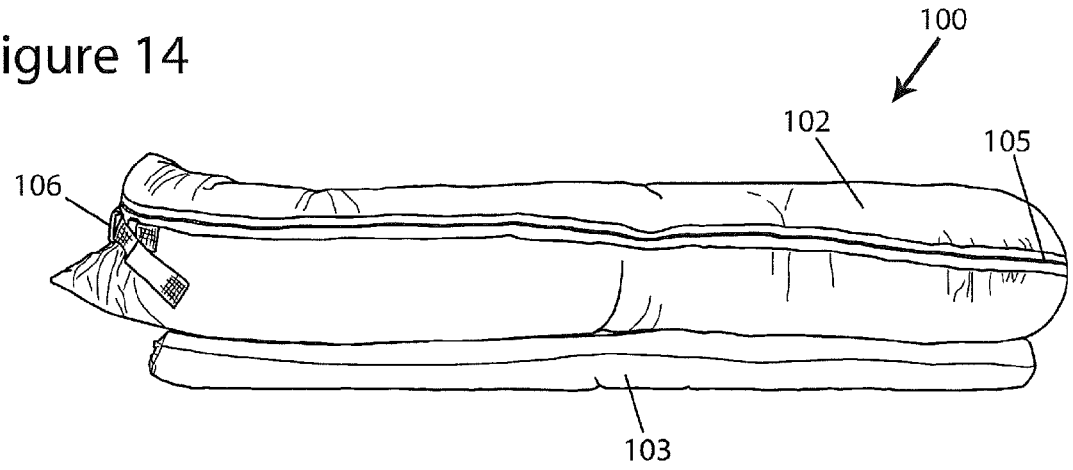
FIG. 14 is a side view of the multifunctional bed of FIG. 13.
Figure 15:
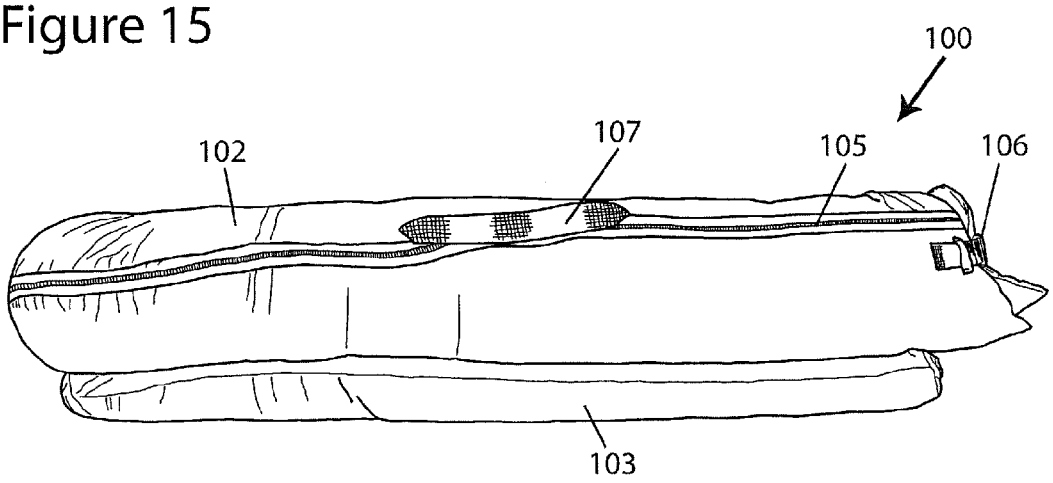
FIG. 15 is a side view of the opposite side of the multifunctional bed of FIG. 13.

As can be seen in FIG. 13, the multifunctional bed 100 includes a shell 101. The shell 101 is preferably made of a breathable, machine washable material such as cotton and may be composed of a coated non-woven material. The shell 101 may have anti-dust-mite, anti-fungal and anti-bacterial properties. With reference to FIGS. 13-22, the shell 101 preferably has a bumper 102 and a bottom 103.

With reference to FIGS. 13-22, the bumper 102 is preferably in a horseshoe shape, where the ends of the horseshoe of the bumper 102 can be connected with a clasp 106 to form an oval shape. The bumper 102 is preferably attached to the bottom 103. In preferred embodiments the bumper 102 and the bottom 103 are composed of the same fabric and are part of a unitary or continuous structure. Alternatively, with reference to FIG. 23, the bumper 102 may be a separate structure from the bottom 103 and may be fastened to the bottom 103 via a variety of fasteners 112, such as, for example, Velcro™, snaps, buttons or other fasteners.

Figure 21:
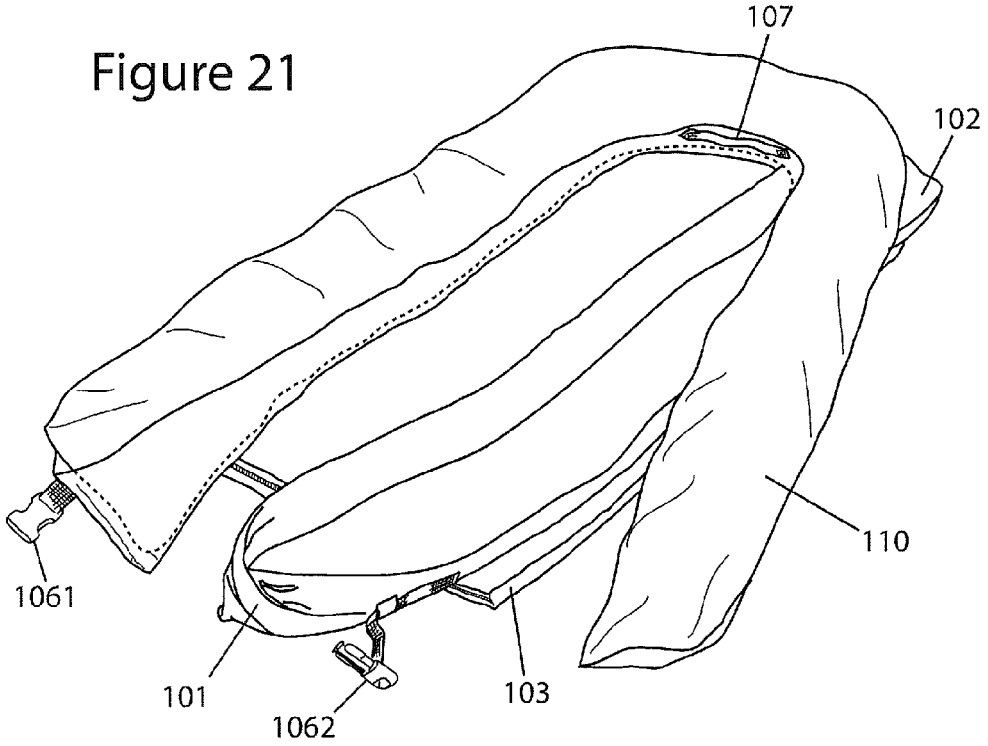
FIG. 21 is a perspective view of the multifunctional bed of FIG. 13 in an open state.

With reference to FIG. 21, the bumper 102 is further preferably filled with an insert 110. The insert 110 is preferably composed of filler material, such as fibers or foam. The filler material may be cluster fibers, foam, thermobonded (poly), or wadding. The filler material may have antimicrobial properties. When the clasp 106 is fastened and the bumper 102 is filled with the insert 110, the bumper 102 is preferably in an oval shape that runs along the perimeter of the multifunctional bed 100. Additionally, when the bumper 102 is filled with the insert 110, the profile of the bumper 102 is preferably raised from the bottom 103, forming a recess 104. The height of the profile of the bumper 102 is preferably high enough to confine an infant within the space of the bumper 102, but low enough to allow an infant to visually observe surroundings. In preferred embodiments, an infant may be placed in the recess 104 of the multifunctional bed 100. The infant may be placed on their back or on their stomach in the recess 104. Alternatively, an infant may be placed partially in the recess 104 and partially on the bumper 102.

Figure 16:
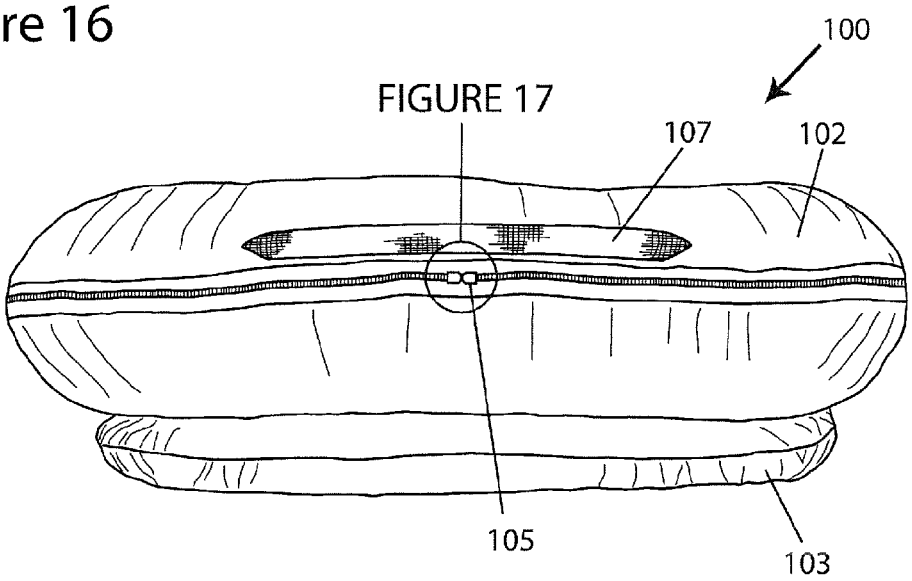
FIG. 16 is a back view of the multifunctional bed of FIG. 13.
Figure 17:
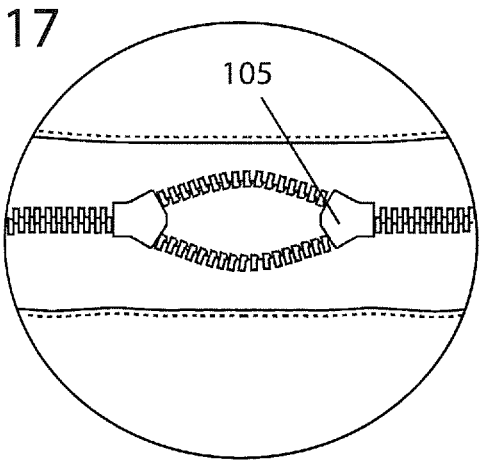
FIG. 17 is a close up view of the bumper zipper of the multifunctional bed of FIG. 16.

With reference to FIGS. 13-22, the bumper 102 preferably has two bumper zippers 105. Alternatively, the bumper 102 may have only one zipper or may have more than two zippers. The bumper zippers 105 preferably run along the entire length of the bumper 102. Alternatively, the bumper zippers 105 may run along only part of the length of the bumper 102. With reference to FIGS. 16 and 17, the bumper zippers 105 are preferably infant safe zippers that include only zipper sliders, and do not include zipper pull tabs. The elimination of the pull tab from the bumper zippers 105 reduces the amount of small parts that may be a choking hazard for an infant. With reference to FIG. 21, when the bumper zippers 105 are in an open state, the insert 110 may be removed from the bumper 102 for cleaning, replacement, or repositioning in bumper 102.

Figure 18:
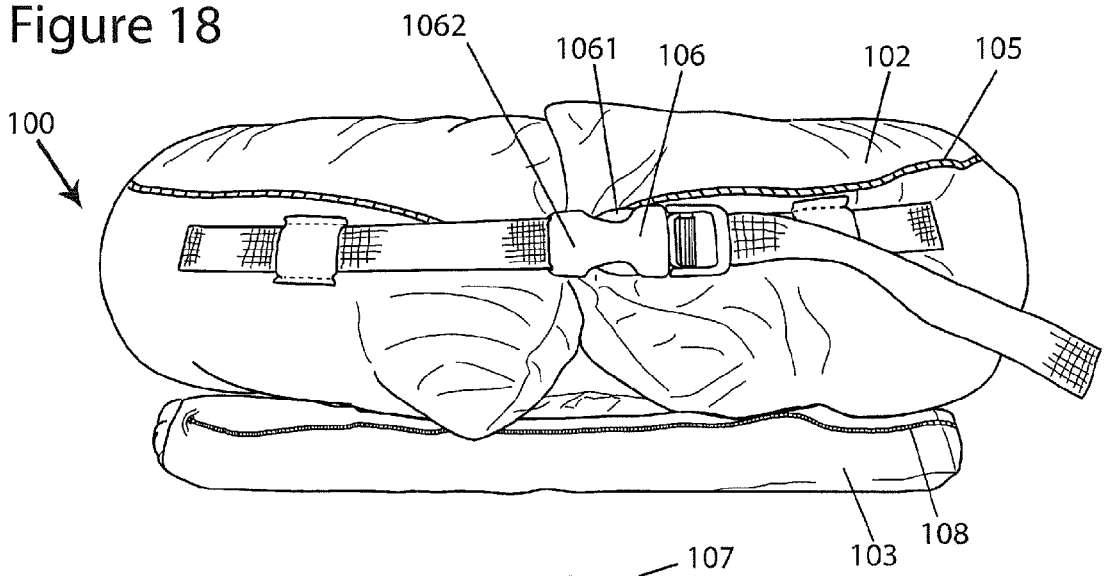
FIG. 18 is a front view of the multifunctional bed of FIG. 13.
Figure 19:
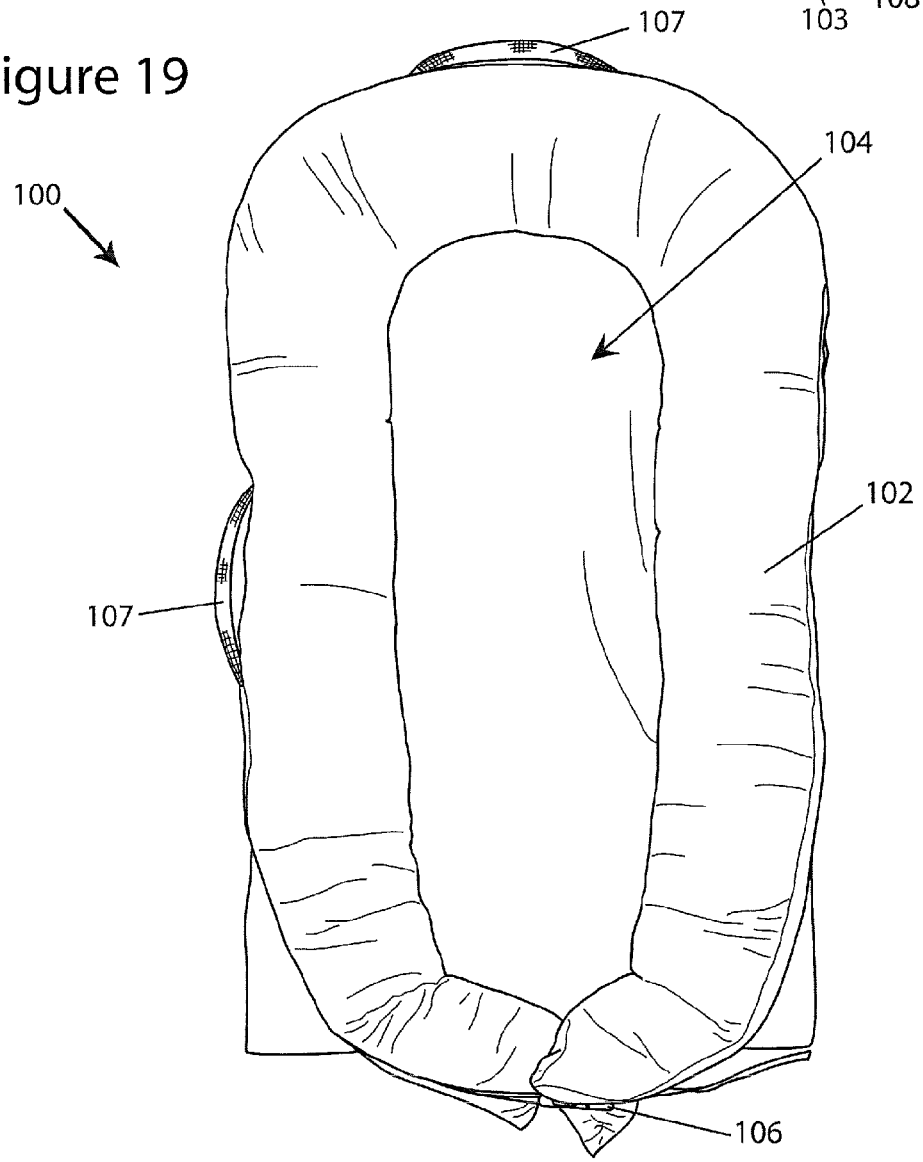
FIG. 19 is a top view of the multifunctional bed of FIG. 13.

With reference to FIG. 18, the clasp 106 of the bumper 102 preferably includes two parts—a male part 1061 and a female part 1062. The clasp 106 preferably connects the ends of bumper 102, forming a recess 104 where an infant may be placed. The male part 1061 is preferably connected to one end of bumper 102 while the female part 1062 is preferably connected to another end of bumper 102. When the clasp 106 is unfastened, the bumper 102 may be in a horseshoe shape, allowing a parent to slide out an infant from the opened end of the bumper 102. Additionally, the clasp 106 may be fastened to the bars of a crib or another stable object, securing the multifunctional bed 100 in place.

The bumper 102 further preferably includes one or more handles 107. With reference to FIGS. 13-22, the bumper 102 may include two handles 107 that allow a user to carry the multifunctional bed 100. The handles 107 may be composed of the same material as the shell 101. Alternatively, the handles 107 may be composed of a different material from the shell 101.

Figure 20:
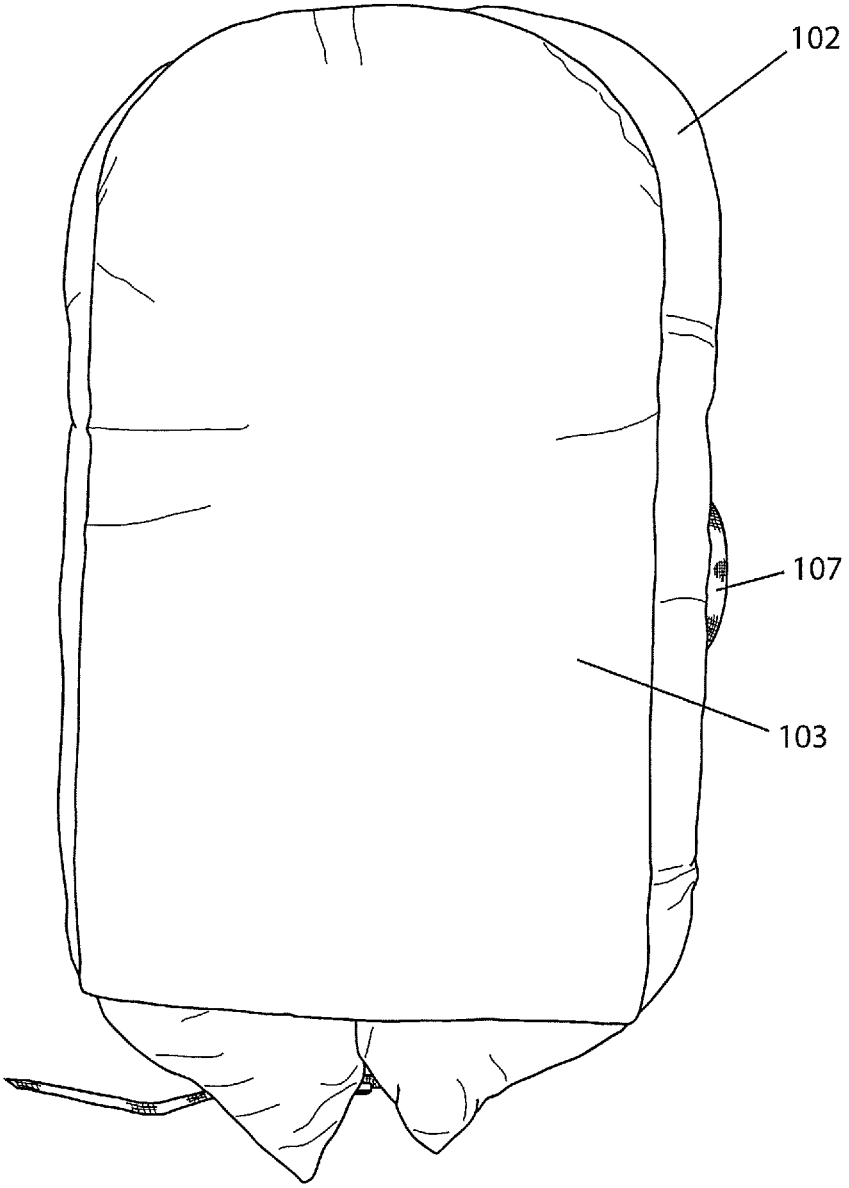
FIG. 20 is a bottom view of the multifunctional bed of FIG. 13.
Figure 22:
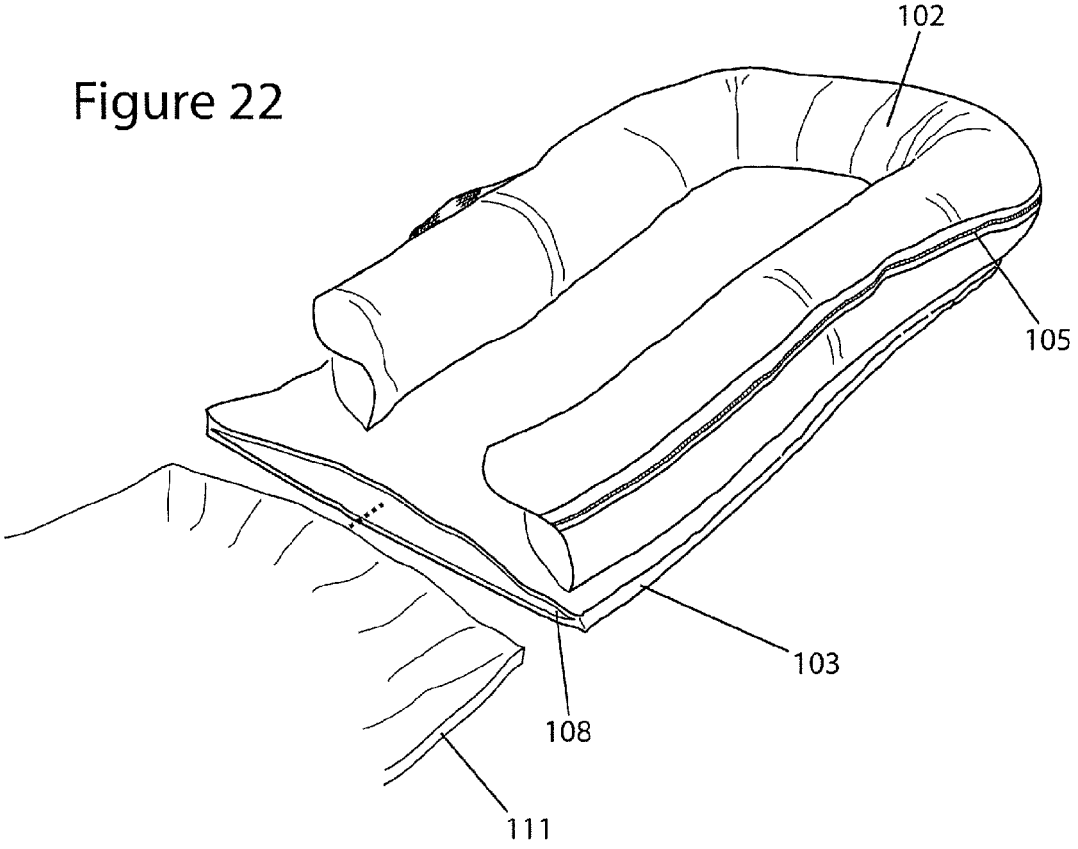
FIG. 22 is an exploded perspective view of the multifunctional bed of FIG. 13.
Figure 23:
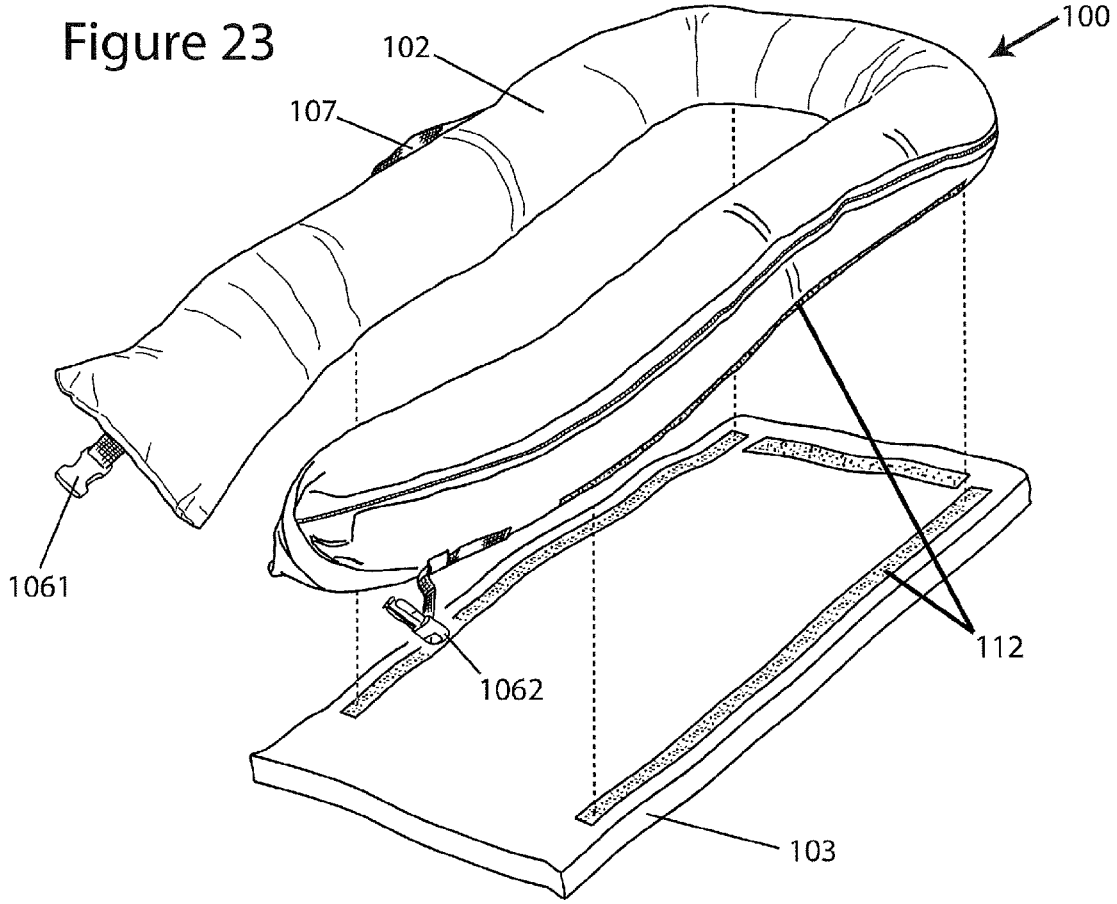
FIG. 23 is an exploded perspective view of a multifunctional bed according to yet another alternative embodiment of the present invention.
Figure 24:
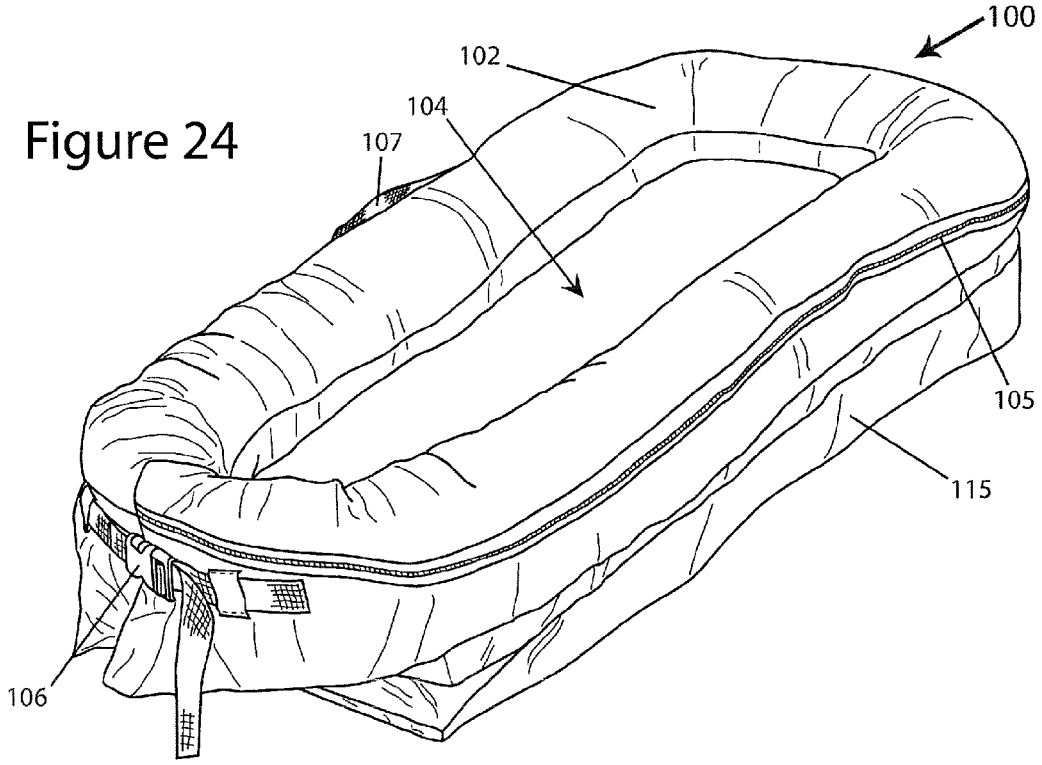
FIG. 24 is a perspective view of the multifunctional bed of FIG. 13 positioned on a base.
Figure 25:
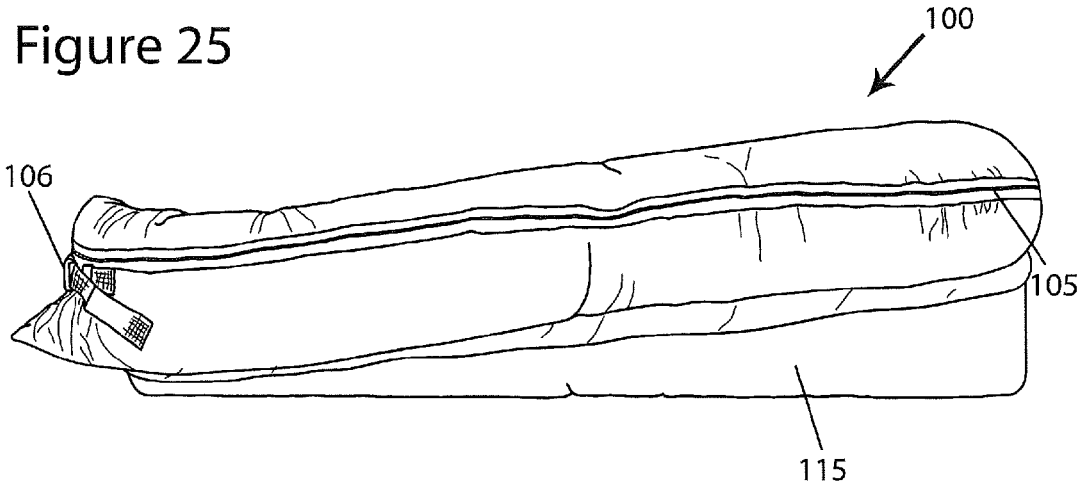
FIG. 25 is a side view of the multifunctional bed and base of FIG. 24.
Figure 26:
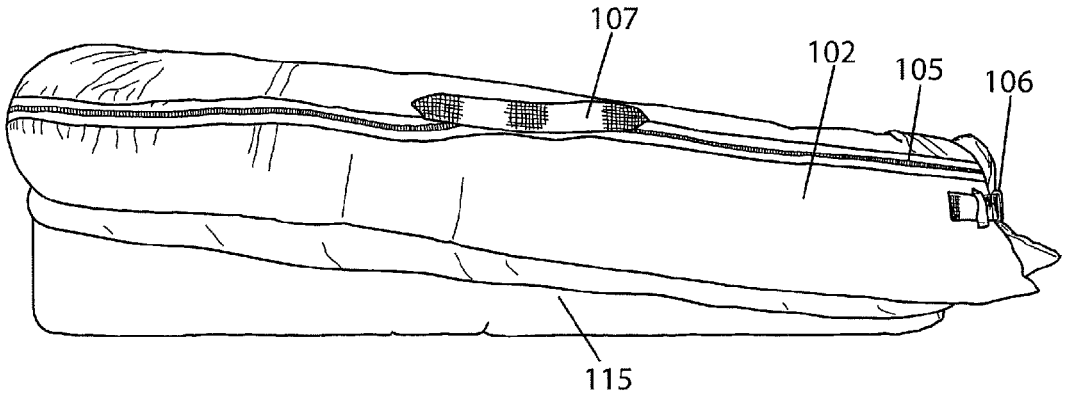
FIG. 26 is a side view of the other side of the multifunctional bed and base of FIG. 24.
Figure 27:
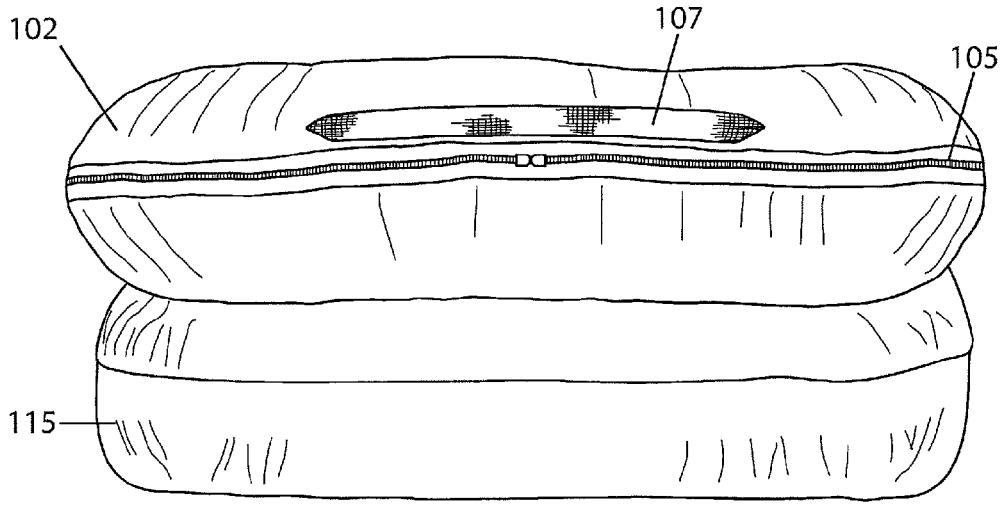
FIG. 27 is a back view of the multifunctional bed and base of FIG. 24.

With reference to FIG. 20, the bottom 103 is preferably partially rectangular and partially rounded shape. The part of the bottom 103 that is closest to the clasp 106 has a rectangular shape while the part of the bottom 103 furthest from the clasp 106 has a rounded shape. The bottom 103 is preferably filled with an insert 111. The insert 110 is preferably composed of filler material, such as fibers or foam. The filler material may be luster fibers, foam, thermobonded (poly) fiber, or wadding. The filler material may have antimicrobial properties. When the bottom 103 is filled with the insert 111, it preferably provides a soft, yet firm, surface for an infant to lie on. The bottom 103 preferably includes a bottom zipper 108. The bottom zipper 108 is preferably an infant safe zipper that includes only a zipper slider, and, similar to bumper zippers 105, does not include a zipper pull tab. With reference to FIG. 22, when the bottom zipper 108 is in an open position, a user may remove the insert 111 from the bottom 103 for cleaning, replacement, or repositioning.

With reference to FIGS. 24-27, the multifunctional bed 100 can be positioned on a base 115. In preferred embodiments, the base 115 is in an incline wedge shape. The base 115 is separate from and attachable to the multifunctional bed 100. The base 115 has a shell and is preferably filled with filler material. The filler material may include cluster fibers, foam, thermobonded (poly) fiber, or wadding. The base 115 may be attached to the multifunctional bed 100 via a plurality of fasteners, such as, for example, Velcro™, snaps, buttons, zippers, or other fasteners. The attachment of the base 115 to the multifunctional bed 100 creates an incline position for an infant, where the infant's head is raised relative to the infant's body. This position can relieve an infant's reflux or other abdominal problems. Additionally, when an infant has a cold, this incline position allows the infant to breathe easier.

Another embodiment of a multifunctional bed 200 is illustrated in FIGS. 28-38. The multifunctional bed 200 may be used as a standalone product, or may be used as a crib or cot insert. The multifunctional bed 200 may be used by a parent when co-sleeping with an infant. The multifunctional bed 200 preferably has anti-dust-mite, anti-fungal and anti-bacterial properties.

Figure 28:
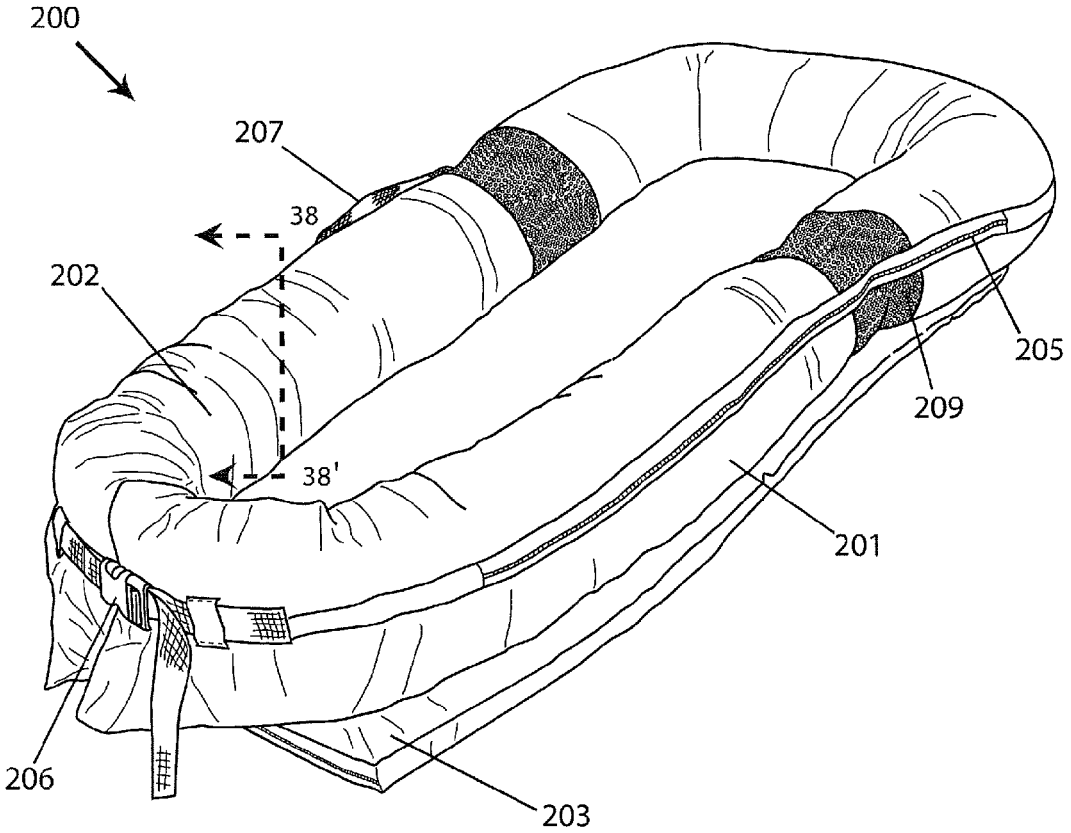
FIG. 28 is a perspective view of a multifunctional bed according to yet another alternative embodiment of the present invention.

As can be seen in FIG. 28, the multifunctional bed 200 includes a shell 201. The shell 201 is preferably made of a breathable, machine washable material such as cotton and may be composed of a coated non-woven material. The shell 201 may have anti-dust-mite, anti-fungal and anti-bacterial properties. With reference to FIGS. 28-38, the shell 201 preferably has a bumper 202 and a bottom 203.

With reference to FIGS. 28-38, the bumper 202 is preferably in a horseshoe shape, where the ends of the horseshoe of the bumper 202 can be connected with a clasp 206 to form an oval shape. The bumper 202 is preferably attached to the bottom 203. In preferred embodiments the bumper 202 and the bottom 203 are composed of the same fabric and are part of a continuous structure. Alternatively, with reference to FIG. 39, the bumper 202 may be a separate structure from the bottom 203 and may be fastened to the bottom 203 via a variety of fasteners 212, such as, for example, Velcro™, snaps, buttons or other fasteners.

Figure 29:
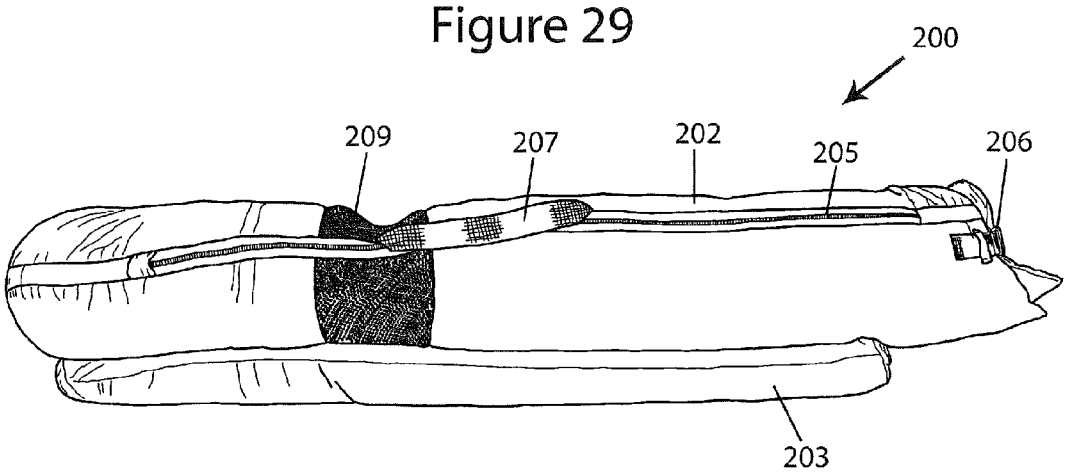
FIG. 29 is a side view of the multifunctional bed of FIG. 28.
Figure 30:
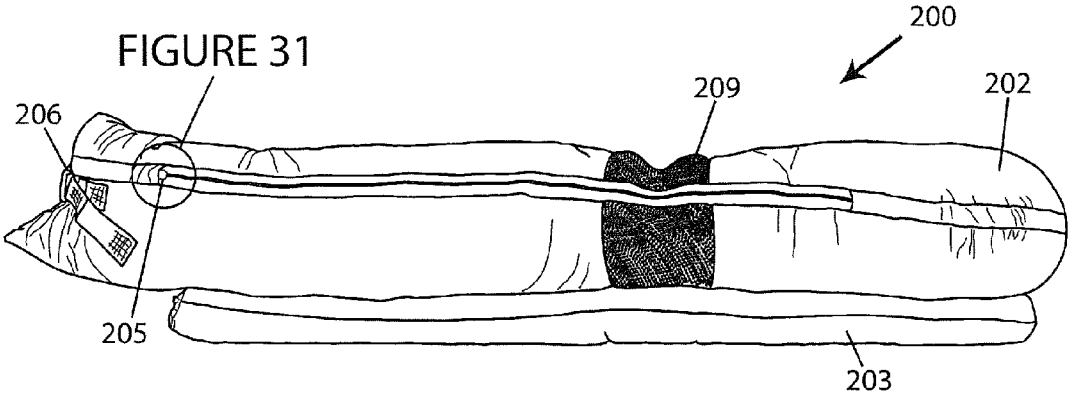
FIG. 30 is a side view of the opposite side of the multifunctional bed of FIG. 28.

With reference to FIGS. 28-30, the bumper 202 preferably includes mesh sections 209. The mesh sections 209 are preferably located on each long side of the bumper 202. The mesh windows 209 are preferably located substantially where an infant's head would be located when the infant is laying down. The mesh windows 209 preferably allow an infant pressed against them to breathe air by allowing airflow between the inside and outside of the multifunctional bed 200 through or in the region of the bumper 202.

Figure 36:
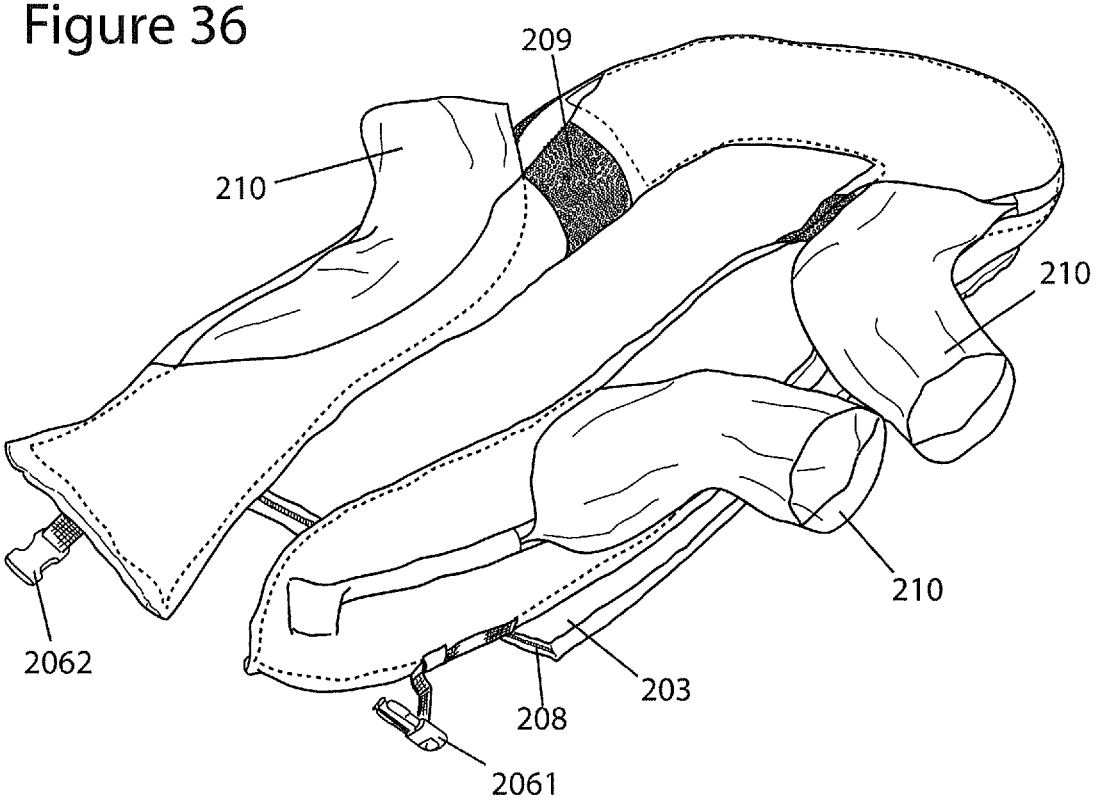
FIG. 36 is a perspective view of the multifunctional bed of FIG. 28 in an open state.
Figure 38:
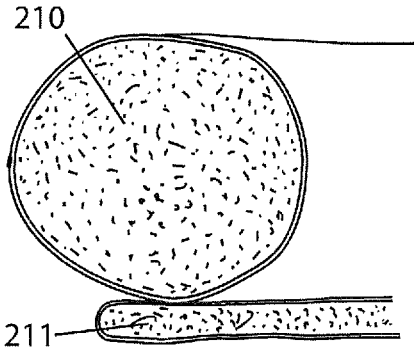
FIG. 38 is a cross-sectional view of the multifunctional bed of FIG. 28 taken along the lines 38-38'.
Figure 39:
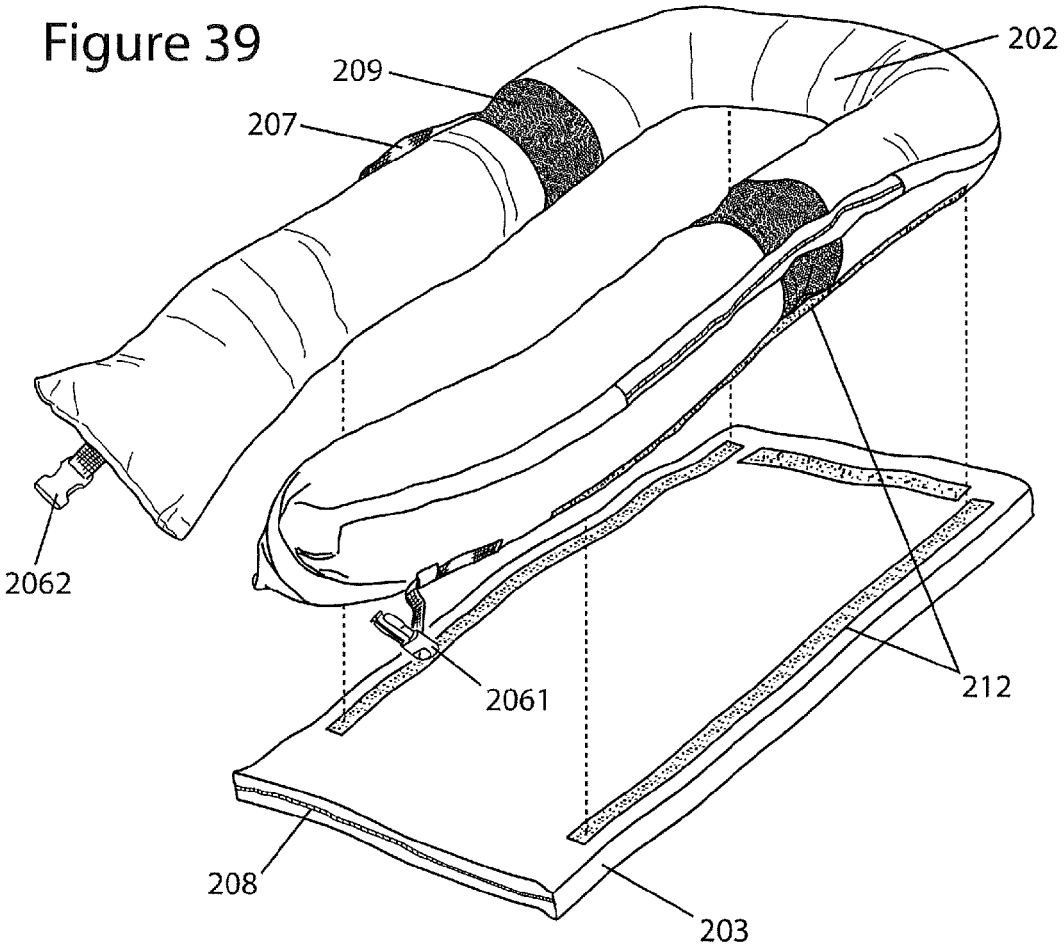
FIG. 39 is an exploded perspective view of a multifunctional bed according to yet another embodiment of the present invention.
Figure 40:
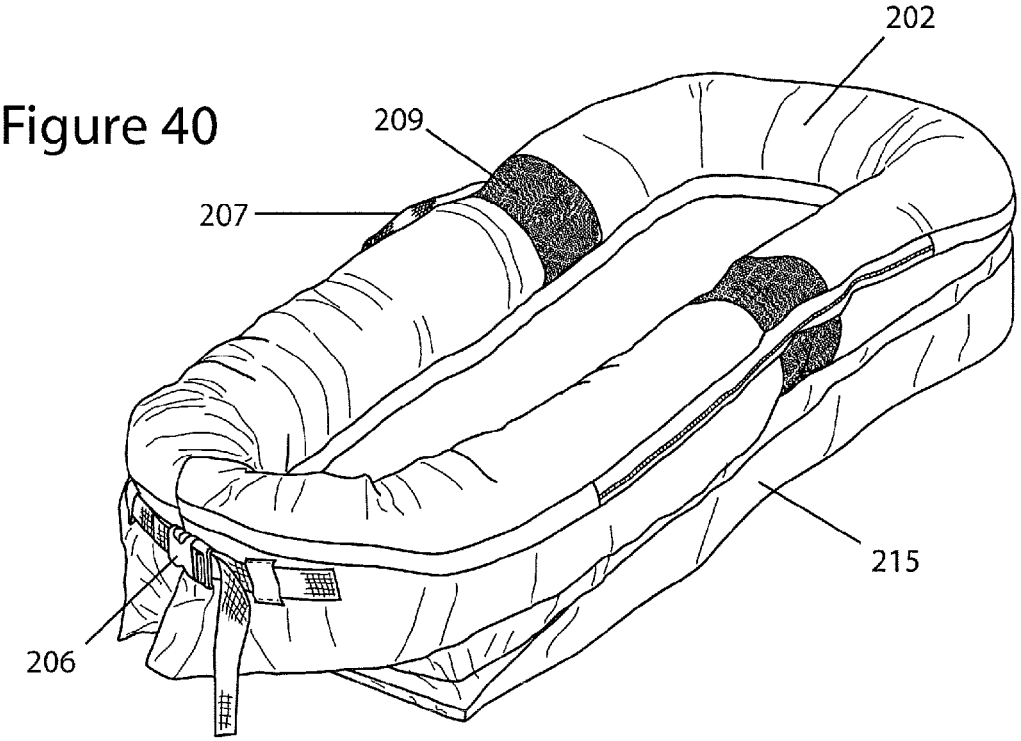
FIG. 40 is a perspective view of the multifunctional bed of FIG. 28 positioned on a base.
Figure 41:
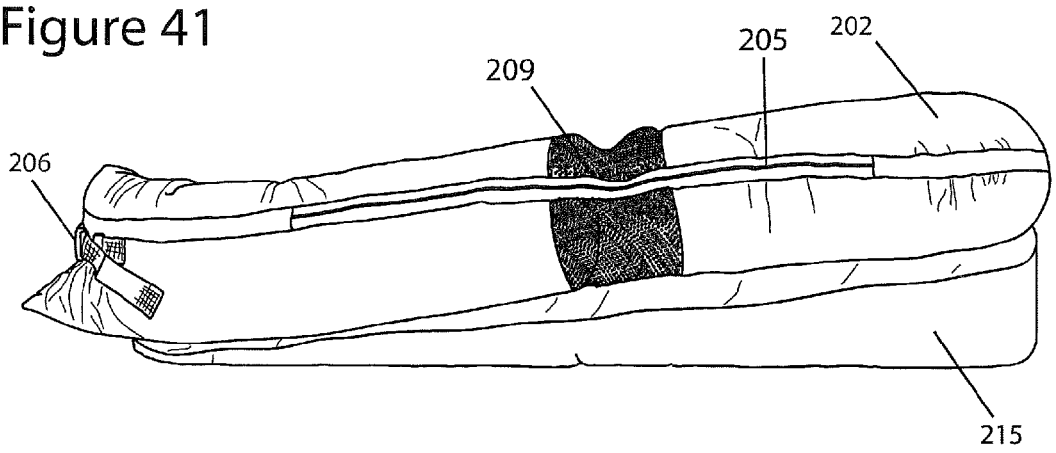
FIG. 41 is a side view of the multifunctional bed and base of FIG. 40.
Figure 42:
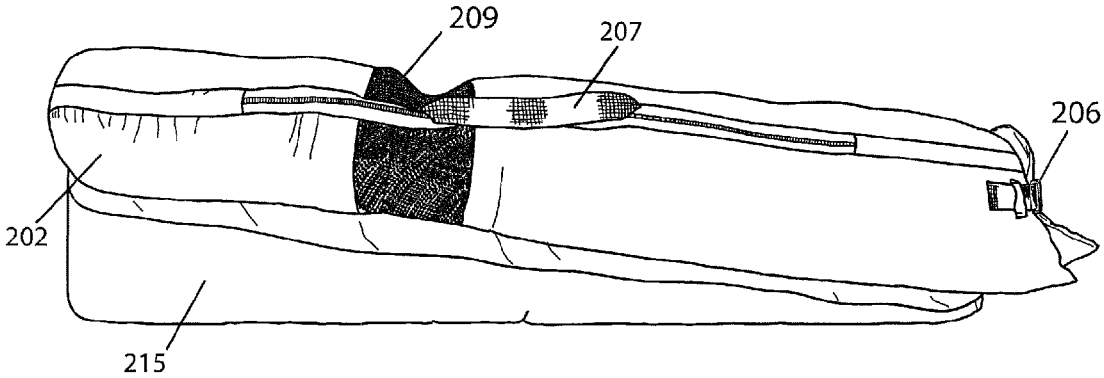
FIG. 42 is a side view of the other side of the multifunctional bed and base of FIG. 40.
Figure 43:
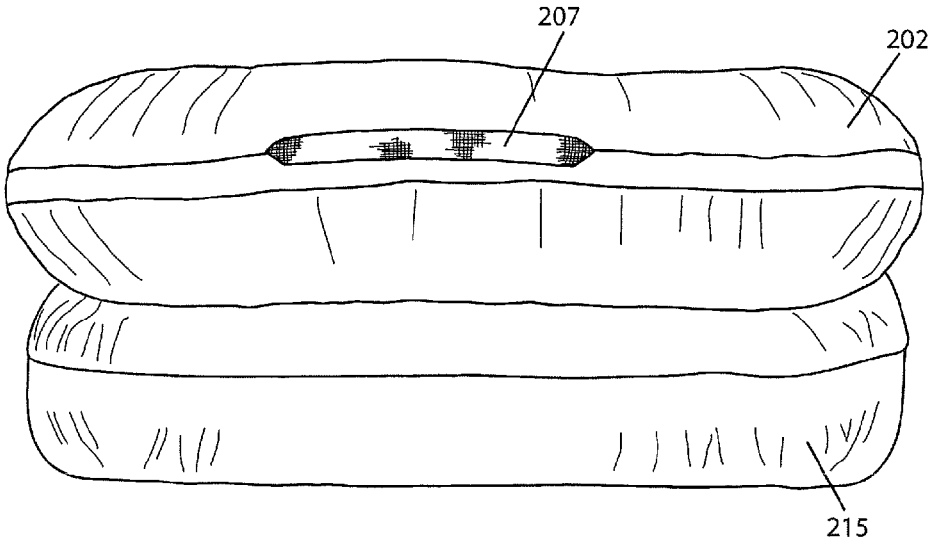
FIG. 43 is a back view of the multifunctional bed and base of FIG. 40.

With reference to FIGS. 36 and 38, the bumper 202 is further preferably filled with inserts 210. The inserts 210 is preferably composed of filler material, such as foam or fibers. The filler material may be cluster fibers, foam, thermobonded (poly) fiber, or wadding. The filler material may have antimicrobial properties. The inserts 210 preferably have indentations where the mesh windows 209 are located. The indentations preferably have no part of the inserts 210 located within them. Alternatively, the indentations may have minimal parts of the inserts 210 located within them so as to allow air flow in or near the region of the bumper. This will allow an infant to still inhale sufficient air when pressed against the mesh windows 209.

Additionally, the bumper 202 in the region of the mesh windows 209 may be provided with stents or supports so as to maintain the shape of the bumper even though the region of the mesh windows 209 may not be provided with sufficient filling so as to maintain its shape. The stents or supports may be anchored to the filling material of the bumper on either side of the mesh window 209 so as to be supported across the length of the mesh window 209.

With reference to FIGS. 28-38, when the clasp 206 is fastened and the bumper 202 is filled with the inserts 210, the bumper 202 is preferably in an oval shape that runs along the perimeter of the multifunctional bed 200. Additionally, when the bumper 202 is filled with the inserts 210, the profile of the bumper 202 is preferably raised from the bottom 203, forming a recess 204. The height of the profile of the bumper 202 is preferably high enough to confine an infant within the space of the bumper 202, but low enough to allow an infant to visually observe their surroundings. In preferred embodiments, an infant may be placed in the recess 204 of the multifunctional bed 200. The infant may be placed on their back or on their stomach in the recess 204. Alternatively, an infant may be placed partially in the recess 204 and partially on the bumper 202.

Figure 31:
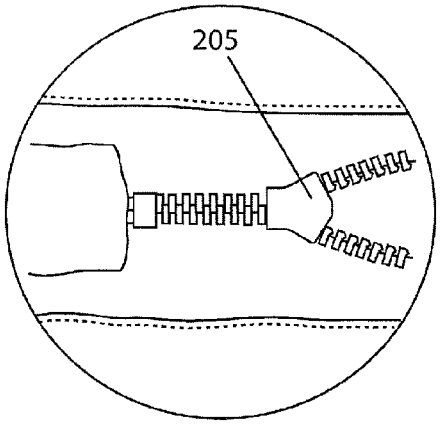
FIG. 31 is a close up view of the bumper zipper of the multifunctional bed of FIG. 30.
Figure 32:
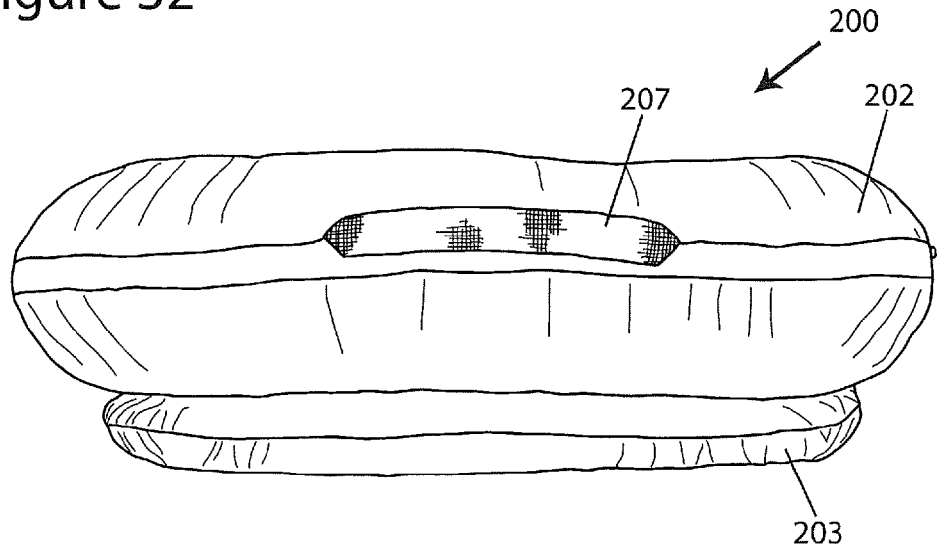
FIG. 32 is a back view of the multifunctional bed of FIG. 28.

With reference to FIGS. 28-38, the bumper 202 preferably has two bumper zippers 205. Alternatively, the bumper 202 may have only one zipper or may have more than two zippers. The bumper zippers 205 preferably run along the entire length of the bumper 202. Alternatively, the bumper zippers 205 may run along only part of the length of the bumper 202. With reference to FIG. 31, the bumper zippers 205 are preferably infant safe zippers that include only zipper sliders, and do not include zipper pull tabs. The elimination of the pull tab from the bumper zippers 205 reduces the amount of small parts that may be a choking hazard for an infant. With reference to FIG. 36, when the bumper zippers 205 are in an open state, the inserts 210 may be removed from the bumper 102 for cleaning, replacement, or repositioning in bumper 202.

Figure 33:
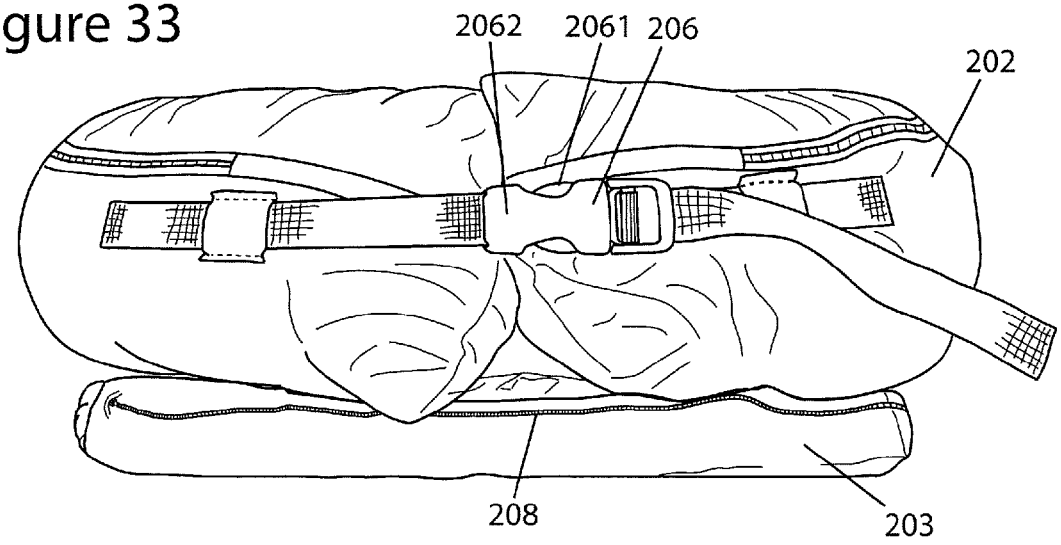
FIG. 33 is a front view of the multifunctional bed of FIG. 28.
Figure 34:
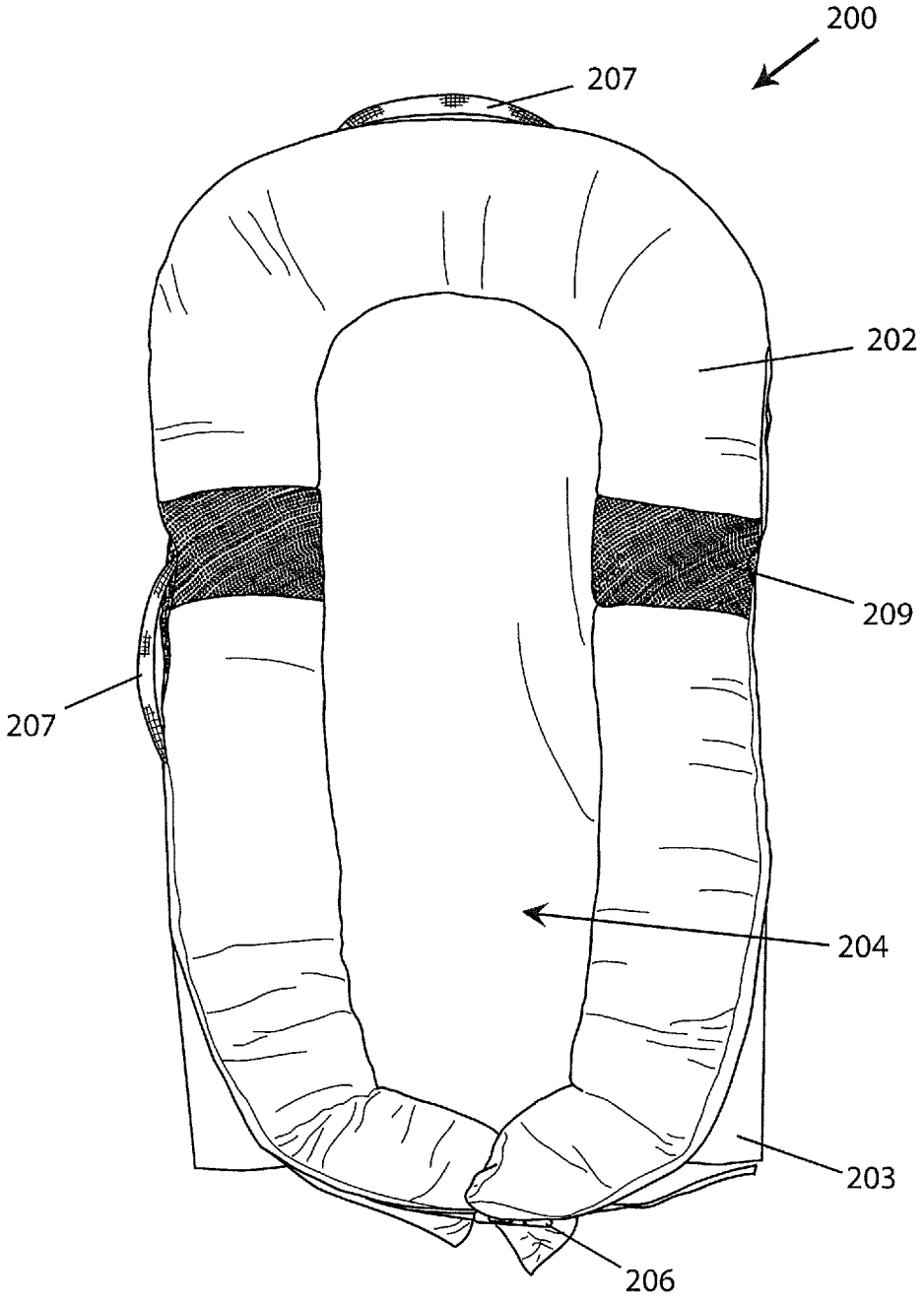
FIG. 34 is a top view of the multifunctional bed of FIG. 28.

With reference to FIG. 33, the clasp 206 of the bumper 202 preferably includes two parts—a male part 2061 and a female part 2062. The clasp 6 preferably connects the ends of bumper 202, forming a recess 204 where an infant may be placed. The male part 2061 is preferably connected to one end of bumper 202 while the female part 2062 is preferably connected to another end of bumper 202. When the clasp 206 is unfastened, the bumper 202 may be in a horseshoe shape, allowing a parent to slide out an infant from the opened end of the bumper 202. Additionally, the clasp 206 may be fastened to the bars of a crib or another stable object, securing the multifunctional bed 200 in place.

The bumper 202 further preferably includes one or more handles 207. With reference to FIGS. 28-38, the bumper 202 may include two handles 207 that allow a user to carry the multifunctional bed 200. The handles 207 may be composed of the same material as the shell 201. Alternatively, the handles 207 may be composed of a different material from the shell 201.

Figure 35:
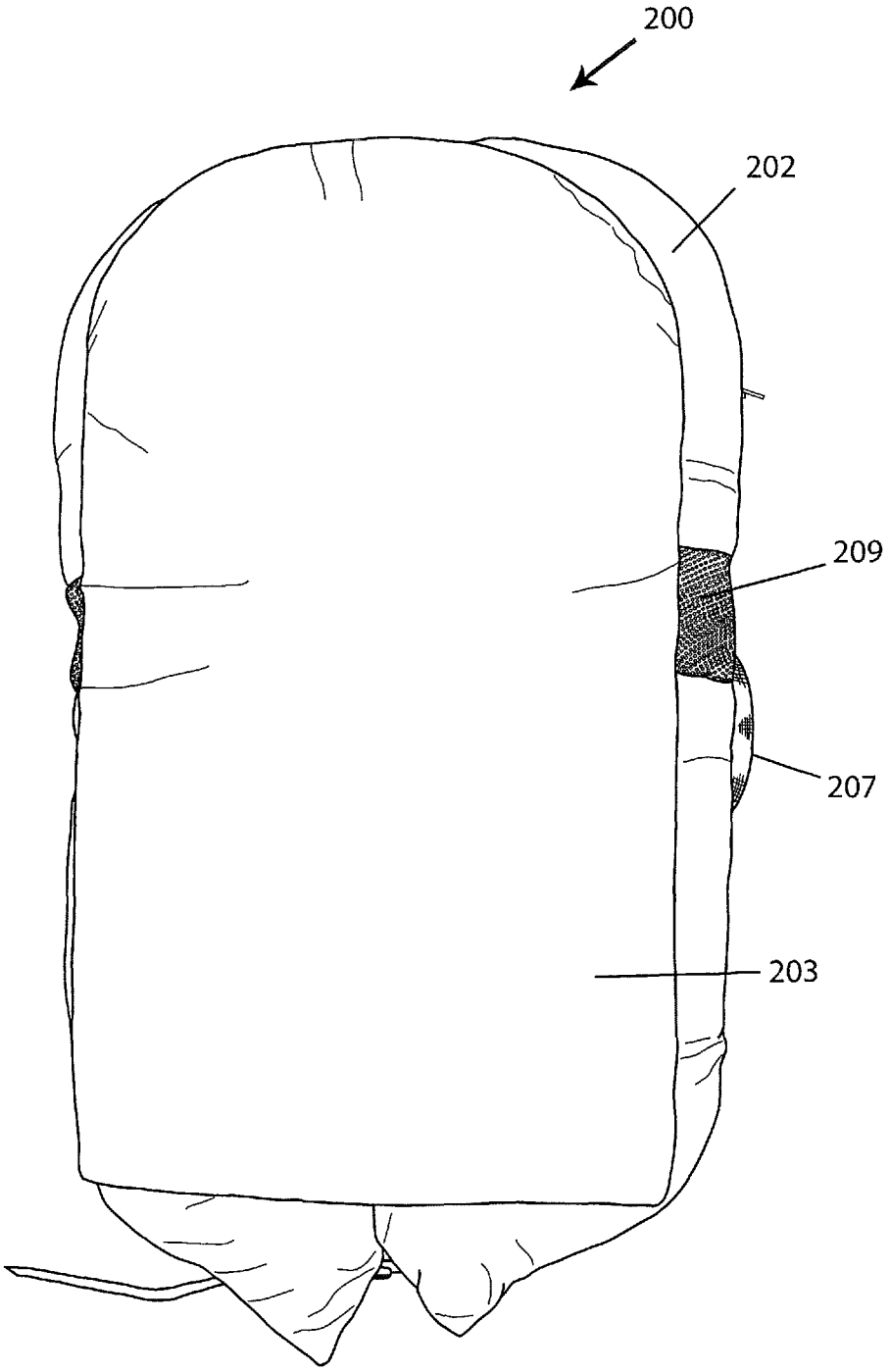
FIG. 35 is a bottom view of the multifunctional bed of FIG. 28.
Figure 37:
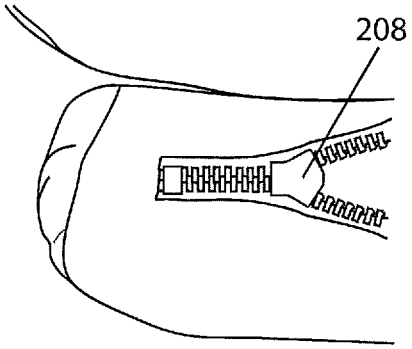
FIG. 37 is a close up view of the bottom zipper of the multifunctional bed of FIG. 36.

With reference to FIGS. 28-38, the bottom 203 is preferably partially rectangular and partially rounded shape. With reference to FIG. 35, the part of the bottom 203 that is closest to the clasp 206 has a rectangular shape while the part of the bottom 203 furthest from the clasp 206 has a rounded shape. With reference to FIG. 38, the bottom 203 is preferably filled with an insert 211. The insert 211 is preferably composed of filler material, such as foam or fibers. The filler material may be cluster fibers, foam, thermobonded (poly) fiber, or wadding. The fibers may have antimicrobial properties. When the bottom 203 is filled with the insert 211, it preferably provides a soft, yet firm, surface for an infant to lie on. The bottom 203 preferably includes a bottom zipper 208. With reference to FIG. 37, the bottom zipper 208 is preferably an infant safe zipper that includes only a zipper slider, and, similar to bumper zippers 205, does not include a zipper pull tab. When the bottom zipper 208 is in an open position, a user may remove the insert 211 from the bottom 203 for cleaning, replacement, or repositioning.

With reference to FIGS. 40-43, the multifunctional bed 200 can be positioned on a base 215. In preferred embodiments, the base 215 is in an incline wedge shape. The base 215 is separate from and attachable to the multifunctional bed 200. The base 215 has a shell and is preferably filled with filler material. The filler material may include cluster fibers, foam, thermobonded (poly) fiber, or wadding. The base 215 may be attached to the multifunctional bed 200 via a plurality of fasteners, such as, for example, Velcro™, snaps, buttons, zippers, or other fasteners. The attachment of the base 215 to the multifunctional bed 200 creates an incline position for an infant, where the infant's head is raised relative to the infant's body. This position can relieve an infant's reflux or other abdominal problems. Additionally, when an infant has a cold, this incline position allows the infant to breathe easier.

While the invention has been particularly shown and described with reference to preferred embodiments thereof, it will be understood by those skilled in the art that various changes in form and details may be made therein without departing from the spirit and scope of the invention. Accordingly, the invention is to be limited only by the scope of the claims and their equivalents.

Any number of the features of the different embodiments described herein may be combined into one single embodiment, the locations of particular elements can be altered and alternate embodiments having fewer than or more than all of the features herein described are possible. Functionality may also be, in whole or in part, distributed among multiple components, in manners now known or to become known.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention. While there had been shown and described fundamental features of the invention as applied to being exemplary embodiments thereof, it will be understood that omissions and substitutions and changes in the form and details of the disclosed invention may be made by those skilled in the art without departing from the spirit of the invention. Moreover, the scope of the present invention covers conventionally known, future developed variations and modifications to the components described herein as would be understood by those skilled in the art.

What is claimed is:

1. A bed, comprising:

a bumper having a first end, a second end, and a fastener having multiple parts, the first end and the second end capable of being joined by the multiple parts of the fastener to provide the bumper with a closed configuration defining a recess, wherein the bumper includes a bumper zipper configurable to provide a bumper zipper opening to allow the removal and insertion of a first filler material disposed in an interior region of the bumper, the bumper zipper extending along substantially the entire length of the bumper from a vicinity of the first end of the bumper to a vicinity of the second end of the bumper;

a substantially fiat and firm bottom portion sized to extend laterally beyond at least a section of the bumper; and, wherein:

the bottom portion and bumper comprise a unitary structure;

the first end of the bumper configured to move with respect to the bed bottom portion;

the second end of the bumper configured to move with respect to the bed bottom portion;

at least one part of the fastener is connected to a first portion of the bumper proximate the first end;

at least another part of the fastener is connected to a second portion of the bumper proximate the second end;

the bumper configured such that when the first end and second end of the bumper are joined, the first portion of the bumper and second portion of the bumper extend laterally beyond the bottom portion of the bed.

2. The bed of claim 1 further comprising a second filling material disposed in an interior region of the bottom portion.

3. The bed of claim 1 further comprising a first handle disposed between the first and second ends of the bumper.

4. The bed of claim 3 further comprising a second handle disposed between the first handle and the second end of the bumper.

5. The bed of claim 2 further comprising a second zipper and a second zipper opening in the bottom to allow the removal and insertion of the second filling material.

6. The bed of claim 1 wherein the bottom includes an inclined upper surface.

7. The bed of claim 1 wherein at least one of the bumper, the bottom, and the filling material has at least one of the properties chosen from the group of: anti-dust-mite, anti-fungal, and anti-bacterial.

8. The bed of claim 1 wherein the bumper has an oval configuration when the bumper is in the closed configuration.

9. The bed of claim 1 wherein the fastener includes a mechanism for adjusting a curvature of the oval configuration and size of the recess.

10. A method for constraining a subject in a bed, the method comprising the steps of:

disposing the subject in the bed, the bed including a bumper having a first end, a second end, and a fastener having multiple parts, the first end and the second end capable of being joined by the multiple parts of the fastener to provide the bumper with a closed configuration defining a recess, wherein the bumper includes a bumper zipper configurable to provide a bumper zipper opening to permit the removal and insertion of a first filler material disposed in an interior region of the bumper, the bumper zipper extending along substantially the entire length of the bumper from a vicinity of the first end of the bumper to a vicinity of the second end of the bumper, a substantially flat and firm bottom portion sized to extend laterally beyond at least a section of the bumper, and, wherein the bottom portion and bumper comprise a unitary structure; and squeezing the subject by:

configuring the bumper in the closed configuration; and adjusting the fastener;

wherein:

the first end of the bumper configured to move with respect to the bed bottom portion;

the second end of the bumper configured to move with respect to the bed bottom portion;

at least one part of the fastener is connected to a first portion of the bumper proximate the first end;

at least another part of the fastener is connected to a second portion of the bumper proximate the second end;

the bumper configured such that when the first end and second end of the bumper are joined, the first portion of the bumper and second portion of the bumper extend laterally beyond the bottom portion of the bed.

11. The method of claim 10 wherein the fastener includes a mechanism for adjusting the curvature and size of the recess, the configuring step of the method further comprising the step of fastening the fastener, and the adjusting step of the method further comprising adjusting the mechanism of the fastener to change the size of the recess and to dispose the bumper in a womb-shaped configuration.

12. The method of claim 10 wherein the bed further includes a first handle disposed on the bumper between the first end and second end of the bumper.

13. The bed of claim 12 wherein the bed further includes a second handle disposed on the bumper between the first handle and the second end of the bumper.

* * * * *